US007798258B2

(12) United States Patent
Singh et al.

(10) Patent No.: US 7,798,258 B2
(45) Date of Patent: Sep. 21, 2010

(54) DRILL BIT WITH CUTTER ELEMENT HAVING CROSSING CHISEL CRESTS

(75) Inventors: Amardeep Singh, Houston, TX (US); Mohammed Boudrare, Bossier City, LA (US)

(73) Assignee: Smith International, Inc., Houston, TX (US)

( * ) Notice: Subject to any disclaimer, the term of this patent is extended or adjusted under 35 U.S.C. 154(b) by 170 days.

(21) Appl. No.: 11/947,226

(22) Filed: Nov. 29, 2007

(65) Prior Publication Data

US 2008/0156544 A1 Jul. 3, 2008

Related U.S. Application Data

(60) Provisional application No. 60/883,283, filed on Jan. 3, 2007.

(51) Int. Cl.
*E21B 10/56* (2006.01)

(52) U.S. Cl. ..... 175/430; 175/426

(58) Field of Classification Search ..... 175/430, 175/74, 426

See application file for complete search history.

(56) References Cited

U.S. PATENT DOCUMENTS

| | | | |
|---|---|---|---|
| 2,578,593 | A | 12/1951 | Phipps |
| 3,388,757 | A | 6/1968 | Fittinger |
| 3,442,342 | A | 5/1969 | McElya et al. |
| 3,946,820 | A | 3/1976 | Knapp |
| 4,056,153 | A | 11/1977 | Miglierini |
| 4,058,177 | A | 11/1977 | Langford, Jr. et al. |
| 4,086,973 | A | 5/1978 | Keller et al. |
| 4,108,260 | A | 8/1978 | Bozarth |
| 4,254,840 | A | 3/1981 | Shay, Jr. |
| 4,334,586 | A | 6/1982 | Schumacher |

(Continued)

FOREIGN PATENT DOCUMENTS

| | | |
|---|---|---|
| EP | 0 391 683 | 10/1990 |

(Continued)

OTHER PUBLICATIONS

Search Report for Appln. No. GB 0 403 620.8 dated May 5, 2004 (2 p.).

(Continued)

*Primary Examiner*—David J Bagnell
*Assistant Examiner*—Catherine Loikith
(74) *Attorney, Agent, or Firm*—Christie, Parker & Hale, LLP

(57) ABSTRACT

A drill bit for cutting a borehole comprises a bit body including a bit axis. In addition, the drill bit comprises a rolling cone cutter mounted on the bit body. Further, the drill bit comprises a cutter element having a base portion with a diameter and a cutting portion extending therefrom. The cutting portion comprising a first pair of flanking surfaces that taper towards one another to form a first elongate chisel crest, and a second pair of flanking surfaces that taper towards one another to form a second elongate chisel crest that intersects the first elongate chisel crest in top view. The first crest tangent angle at 10% of the diameter measured radially from the central axis on the first elongate chisel crest in profile view is greater than 75° and less than or equal to 90°.

25 Claims, 13 Drawing Sheets

U.S. PATENT DOCUMENTS

| | | | | |
|---|---|---|---|---|
| 4,352,400 | A | 10/1982 | Grappendorf et al. | |
| 4,511,006 | A | 4/1985 | Grainger | |
| 4,586,574 | A | 5/1986 | Grappendorf | |
| 4,716,977 | A | 1/1988 | Huffstutler | |
| 4,722,405 | A | 2/1988 | Langford, Jr. | |
| 4,811,801 | A | 3/1989 | Salesky et al. | |
| 4,832,139 | A | 5/1989 | Minikus et al. | |
| 4,854,405 | A | 8/1989 | Stroud | |
| 4,951,762 | A | 8/1990 | Lundell | |
| D324,527 | S | 3/1992 | Slutz | |
| 5,131,478 | A | 7/1992 | Brett et al. | |
| 5,172,777 | A | 12/1992 | Siracki et al. | |
| 5,172,779 | A | 12/1992 | Siracki et al. | |
| 5,197,555 | A | 3/1993 | Estes | |
| 5,201,376 | A | 4/1993 | Williams | |
| 5,303,787 | A | 4/1994 | Brady | |
| 5,322,138 | A | 6/1994 | Siracki | |
| 5,323,865 | A | 6/1994 | Isbell et al. | |
| 5,341,890 | A | 8/1994 | Cawthorne et al. | |
| 5,351,768 | A | 10/1994 | Scott et al. | |
| 5,372,210 | A | 12/1994 | Harrell | |
| 5,379,854 | A | 1/1995 | Dennis | |
| 5,407,022 | A | 4/1995 | Scott et al. | |
| 5,415,244 | A | 5/1995 | Portwood | |
| 5,421,423 | A | 6/1995 | Huffstutler | |
| 5,421,424 | A | 6/1995 | Portwood et al. | |
| 5,429,199 | A | 7/1995 | Sheirer et al. | |
| 5,429,200 | A | 7/1995 | Blackman et al. | |
| 5,452,771 | A | 9/1995 | Blackman et al. | |
| 5,479,997 | A | 1/1996 | Scott et al. | |
| 5,518,077 | A | 5/1996 | Blackman et al. | |
| 5,533,582 | A | 7/1996 | Tibbitts | |
| 5,535,839 | A | 7/1996 | Brady | |
| 5,542,485 | A | 8/1996 | Pessier et al. | |
| 5,560,440 | A | 10/1996 | Tibbits | |
| 5,592,995 | A | 1/1997 | Scott et al. | |
| 5,636,700 | A | 6/1997 | Shamburger, Jr. | |
| 5,644,956 | A | 7/1997 | Blackman et al. | |
| 5,695,019 | A | 12/1997 | Shamburger, Jr. | |
| 5,697,462 | A | 12/1997 | Grimes et al. | |
| 5,709,278 | A | 1/1998 | Crawford | |
| 5,743,346 | A | 4/1998 | Flood et al. | |
| 5,746,280 | A | 5/1998 | Scott et al. | |
| 5,752,573 | A | 5/1998 | Scott et al. | |
| 5,755,301 | A | 5/1998 | Love et al. | |
| 5,813,485 | A | 9/1998 | Portwood | |
| 5,819,861 | A | 10/1998 | Scott et al. | |
| 5,833,020 | A | 11/1998 | Portwood et al. | |
| 5,839,526 | A | 11/1998 | Cisneros et al. | |
| 5,871,060 | A | 2/1999 | Jensen et al. | |
| 5,881,828 | A | 3/1999 | Fischer et al. | |
| 5,887,655 | A | 3/1999 | Haugen et al. | |
| 5,887,668 | A | 3/1999 | Haugen et al. | |
| 5,890,550 | A | 4/1999 | Swadi et al. | |
| 5,915,486 | A | 6/1999 | Portwood et al. | |
| 5,950,745 | A | 9/1999 | Ingmarsson | |
| 5,967,245 | A | 10/1999 | Garcia et al. | |
| 6,029,759 | A | 2/2000 | Sue et al. | |
| 6,053,263 | A | 4/2000 | Meiners | |
| 6,059,054 | A | 5/2000 | Portwood et al. | |
| 6,105,693 | A | 8/2000 | Ingmarsson | |
| 6,105,694 | A | 8/2000 | Scott | |
| D430,578 | S | 9/2000 | Brady | |
| 6,135,219 | A * | 10/2000 | Scott | 175/432 |
| 6,161,634 | A | 12/2000 | Minikus et al. | |
| 6,176,332 | B1 | 1/2001 | Massa et al. | |
| 6,176,333 | B1 * | 1/2001 | Doster | 175/428 |
| 6,196,340 | B1 | 3/2001 | Jensen et al. | |
| 6,199,645 | B1 | 3/2001 | Anderson et al. | |
| 6,202,752 | B1 | 3/2001 | Kuck et al. | |
| 6,202,771 | B1 * | 3/2001 | Scott et al. | 175/432 |
| 6,241,034 | B1 | 6/2001 | Steinke et al. | |
| 6,241,035 | B1 | 6/2001 | Portwood | |
| 6,290,008 | B1 | 9/2001 | Portwood et al. | |
| 6,367,568 | B2 | 4/2002 | Steinke et al. | |
| 6,510,910 | B2 | 1/2003 | Eyre et al. | |
| 6,530,441 | B1 | 3/2003 | Singh et al. | |
| 6,561,293 | B2 | 5/2003 | Minikus et al. | |
| 6,595,305 | B1 | 7/2003 | Dunn et al. | |
| 6,601,662 | B2 | 8/2003 | Matthias et al. | |
| 6,745,645 | B2 | 6/2004 | Griffo | |
| 6,782,959 | B2 | 8/2004 | Minikus et al. | |
| 6,883,624 | B2 * | 4/2005 | McDonough | 175/428 |
| 6,929,079 | B2 * | 8/2005 | McDonough et al. | 175/420.1 |
| 7,013,999 | B2 | 3/2006 | Tufts | |
| 7,040,424 | B2 | 5/2006 | Yong et al. | |
| 7,152,703 | B2 | 12/2006 | Meiners et al. | |
| 7,631,709 | B2 * | 12/2009 | McDonough et al. | 175/430 |
| 2004/0173384 | A1 | 9/2004 | Yong et al. | |
| 2005/0247492 | A1 | 11/2005 | Shen et al. | |
| 2008/0156542 | A1 * | 7/2008 | Baker et al. | 175/331 |
| 2010/0059286 | A1 * | 3/2010 | McDonough et al. | 175/430 |

FOREIGN PATENT DOCUMENTS

| | | |
|---|---|---|
| EP | 0 446 765 | 9/1991 |
| EP | 0 527 506 | 2/1993 |
| EP | 0 902 159 | 3/1999 |
| GB | 2 361 497 | 10/2001 |
| GB | 2 369 841 | 6/2002 |
| GB | 2 393 982 | 4/2004 |
| GB | 2398330 | 8/2004 |
| RU | 2105124 | 2/1998 |
| RU | 2153569 | 7/2000 |
| WO | WO 01/61142 | 8/2001 |

OTHER PUBLICATIONS

Search Report for Appln. No. GB 0 402 108.5 dated Apr. 22, 2004; (1 p.).

Search Report for Appln. No. GB 0 416617.9 dated Sep. 9, 2004; (1 p.).

Search Report for Appln. No. GB 0404709.8 dated Sep. 23, 2004; (1 p.).

Office Action Dated Nov. 24, 2008 for U.S. Appl. No. 11/619,416 (11 p.).

Response to Office Action Dated Nov. 24, 2008 for U.S. Appl. No. 11/619,416 (17 p.).

Final Office Action Dated May 22, 2009 for U.S. Appl. No. 11/619,416 (20 p.).

Response to final Office Action Dated May 22, 2009 for U.S. Appl. No. 11/619,416 (22 p).

Office Action Dated May 17, 2007 for U.S. Appl. No. 11/157,656 (18 p.).

Response to Office Action Dated May 17, 2007 for U.S. Appl. No. 11/157,656 (23 p.).

Office Action Dated Aug. 31, 2007 for U.S. Appl. No. 11/157,656 (12 p.).

Response to Office Action Dated Aug. 31, 2007 for U.S. Appl. No. 11/157,656 (19 p.).

Final Office Action Dated Feb. 19, 2008 for U.S. Appl. No. 11/157,656 (18 p.).

Response to Final Office Action Dated Feb. 19, 2008 for U.S. Appl. No. 11/157,656 (15 p.).

Advisory Action Dated May 5, 2008 for U.S. Appl. No. 11/157,656 (3 p.).

Request for Continued Examination (RCE) and Preliminary Amendment; for U.S. Appl. No. 11/157,656 (25 p.).

Office Action Dated Oct. 17, 2008 for U.S. Appl. No. 11/157,656 (4 p.).

Response to Office Action Dated Oct. 17, 2008 for U.S. Appl. No. 11/157,656 (16?? 5 p??? p.).

Notice of Allowance and Fee(s) Due Dated Dec. 8, 2008 for U.S. Appl. No. 11/157,656 (4 p.).

Office Action Dated Apr. 22, 2009 for U.S. Appl. No. 11/157,656 (8 p.).
Response to Office Action Dated Apr. 22, 2009 for U.S. Appl. No. 11/157,656 (16 p.).
Office Action Dated Sep. 3, 2004 for U.S. Appl. No. 10/371,388 (5 p.).
Response to Office Action Dated Sep. 3, 2004 for U.S. Appl. No. 10/371,388 (15 p.).
Notice of Allowance for U.S. Appl. No. 10/371,388 dated Apr. 13, 2005 (6 p).
Office Action Dated Sep. 23, 2004 for U.S. Appl. No. 10/379,015 (12 p.).
Response to Office Action Dated Sep. 23, 2004 for U.S. Appl. No. 10/379,015 (23 p).
Office Action Dated Feb. 22, 2005 for U.S. Appl. No. 10/379,015 (7 p.).
Response to Office Action Dated Feb. 22, 2005 for U.S. Appl. No. 10/379,015 (19 p).
Office Action dated Aug. 29, 2005 for U.S. Appl. No. 10/379,015 (7 p.).
Response to Office Action dated Aug. 29, 2005 for U.S. Appl. No. 10/379,015 (19 p.).
Notice of Allowance dated Jan. 31, 2006 for U.S. Appl. No. 10/379,016 (6 p.).
Office Action Dated Apr. 28, 2005 for U.S. Appl. No. 10/628,191 (12 p.).
Response to Office Action Dated Apr. 28, 2005 for U.S. Appl. No. 10/628,191 (26 p.).
Notice of Allowance Dated Oct. 12, 2005 for U.S. Appl. No. 10/628,191 (4 p.).
Office Action Dated Apr. 13, 2004 for U.S. Appl. No. 10/355,493 (10 p.).
Response to Office Action Dated Apr. 13, 2004 for U.S. Appl. No. 10/355,493 (32 p.).
Final Office Action Dated Aug. 23, 2004 for U.S. Appl. No. 10/355,493 (7 p.).
Response to Final Office Action Dated Aug. 23, 2004 for U.S. Appl. No. 10/355,493 (19 p).
Notice of Allowance Dated Dec. 20, 2004 for U.S. Appl. No. 10/355,493 (6 p).
Office Action Dated Nov. 13, 2008 for U.S. Appl. No. 11/619,395 (14 p.).
Response to Office Action Dated Nov. 13, 2008 for U.S. Appl. No. 11/619,395 (21 p.).
Notice of Allowance dated Apr. 20, 2009 for U.S. Appl. No. 11/619,395 (6 p.).
Supplemental Response to Final Office Action Dated May 22, 2009 for U.S. Appl. No. 11/619,416; (18 p.).
Advisory Action Dated Aug. 7, 2009 for U.S. Appl. No. 11/619,416; (3 p.).
Notice of Allowance and Fee(s) Due dated Mar. 1, 2010 for U.S. Appl. No. 11/157,656; (9 p.).
Notice of Allowance and Fee(s) Due dated Nov. 16, 2009 for U.S. Appl. No. 11/619,416; (9 p.).
Response Office Action Dated Jul. 9, 2009 for U.S. Appl. No. 11/947,226; (15 p.).
Supplemental Response to Final Office Action Dated May 22, 2009 for U.S. Appl. No. 11/619,416; (18 p.).
Notice of Allowance and Fee(s) Due dated Nov. 16, 2009 for U.S. Appl. No. 11/619,416; (9 p.).
Notice of Allowance and Fee(s) Due dated Mar. 1, 2010 for U.S. Appl. No. 11/157,656; (9 p.).
Office Action Dated Aug. 25, 2009 for U.S. Appl. No. 11/858,359 (24 p.).
* cited by examiner

DRILL BIT WITH CUTTER ELEMENT HAVING CROSSING CHISEL CRESTS

CROSS-REFERENCE TO RELATED APPLICATIONS

This application claims benefit of U.S. provisional application Ser. No. 60/883,283 filed Jan. 3, 2007, and entitled "Drill Bit With Cutter Element Having Crossing Chisel Crests," which is hereby incorporated herein by reference in its entirety.

STATEMENT REGARDING FEDERALLY SPONSORED RESEARCH OR DEVELOPMENT

Not Applicable.

BACKGROUND OF THE TECHNOLOGY

1. Field of the Invention

The invention relates generally to earth-boring bits used to drill a borehole for the ultimate recovery of oil, gas or minerals. More particularly, the invention relates to rolling cone rock bits and to an improved cutting structure and cutter element for such bits.

2. Background Information

An earth-boring drill bit is typically mounted on the lower end of a drill string and is rotated by revolving the drill string at the surface or by actuation of downhole motors or turbines, or by both methods. With weight applied to the drill string, the rotating drill bit engages the earthen formation and proceeds to form a borehole along a predetermined path toward a target zone. The borehole formed in the drilling process will have a diameter generally equal to the diameter or "gage" of the drill bit.

In oil and gas drilling, the cost of drilling a borehole is proportional to the length of time it takes to drill to the desired depth and location. The time required to drill the well, in turn, is greatly affected by the number of times the drill bit must be changed in order to reach the targeted formation. This is the case because each time the bit is changed, the entire string of drill pipes, which may be miles long, must be retrieved from the borehole, section by section. Once the drill string has been retrieved and the new bit installed, the bit must be lowered to the bottom of the borehole on the drill string, which again must be constructed section by section. As is thus obvious, this process, known as a "trip" of the drill string, requires considerable time, effort and expense. Because drilling costs are typically thousands of dollars per hour, it is thus always desirable to employ drill bits which will drill faster and longer and which are usable over a wider range of formation hardness.

The length of time that a drill bit may be employed before it must be changed depends upon its ability to "hold gage" (meaning its ability to maintain a full gage borehole diameter), its rate of penetration ("ROP"), as well as its durability or ability to maintain an acceptable ROP.

One common earth-boring bit includes one or more rotatable cone cutters that perform their cutting function due to the rolling movement of the cone cutters acting against the formation material. The cone cutters roll and slide upon the bottom of the borehole as the bit is rotated, the cone cutters thereby engaging and disintegrating the formation material in its path. The rotatable cone cutters may be described as generally conical in shape and are therefore sometimes referred to as rolling cones, cone cutters, or the like. The borehole is formed as the gouging and scraping or crushing and chipping action of the rotary cones removes chips of formation material which are carried upward and out of the borehole by drilling fluid which is pumped downwardly through the drill pipe and out of the bit.

The earth disintegrating action of the rolling cone cutters is enhanced by providing the cone cutters with a plurality of cutter elements. Cutter elements are generally of two types: inserts formed of a very hard material, such as tungsten carbide, that are press fit into undersized apertures in the cone surface; or teeth that are milled, cast or otherwise integrally formed from the material of the rolling cone. Bits having tungsten carbide inserts are typically referred to as "TCI" bits or "insert" bits, while those having teeth formed from the cone material are commonly known as "steel tooth bits." In each instance, the cutter elements on the rotating cone cutters break up the formation to form new boreholes by a combination of gouging and scraping or chipping and crushing. The shape and positioning of the cutter elements (both steel teeth and tungsten carbide inserts) upon the cone cutters greatly impact bit durability and ROP and thus, are important to the success of a particular bit design.

The inserts in TCI bits are typically positioned in circumferential rows on the rolling cone cutters. Most such bits include a row of inserts in the heel surface of the rolling cone cutters. The heel surface is a generally frustoconical surface configured and positioned so as to align generally with and ream the sidewall of the borehole as the bit rotates. Conventional bits typically include a circumferential gage row of cutter elements mounted adjacent to the heel surface but oriented and sized in such a manner so as to cut the corner of the borehole. Conventional bits also include a number of inner rows of cutter elements that are located in circumferential rows disposed radially inward or in board from the gage row. These cutter elements are sized and configured for cutting the bottom of the borehole, and are typically described as inner row cutter elements or bottomhole cutter elements.

Inserts in TCI bits have been provided with various geometries. One insert typically employed in an inner row may generally be described as a "conical" insert, having a cutting surface that tapers from a cylindrical base to a generally rounded or spherical apex. As a result of this geometry, the front and side profile views of most conventional conical inserts are the same. Such an insert is shown, for example, in FIGS. 4A-C in U.S. Pat. No. 6,241,034. Conical inserts have particular utility in relatively hard formations as the weight applied to the formation through the insert is concentrated, at least initially, on the relatively small surface area of the apex. However, because of the conical insert's relatively narrow profile, in softer formations, it is not able to remove formation material as quickly as would an insert having a wider cutting profile.

Another common shape for an insert for use in inner rows may generally be described as "chisel" shaped. Rather than having the spherical apex of the conical insert, a chisel insert includes two generally flattened sides or flanks that converge and terminate in an elongate crest at the terminal end of the insert. As a result of this geometry, the front profile view of a conventional chisel crest is usually wider than the side profile view. The chisel element may have rather sharp transitions where the flanks intersect the more rounded portions of the cutting surface, as shown, for example, in FIGS. 1-8 in U.S. Pat. No. 5,172,779. In other designs, the surfaces of the chisel insert may be contoured or blended so as to eliminate sharp transitions and to present a more rounded cutting surface, such as shown in FIGS. 3A-D in U.S. Pat. No. 6,241,034 and FIGS. 9-12 in U.S. Pat. No. 5,172,779. In general, it has been understood that, as compared to a similarly sized conical inset, the chisel-shaped insert provides a more aggressive cutting structure that removes formation material at a faster rate for as long as the cutting structure remains intact.

Despite this advantage of chisel-shaped inserts, however, such cutter elements have certain limitations depending on their orientation in the rolling cone cutter. For instance, when a chisel-shaped insert is positioned in the rolling cone with its elongate chisel crest aligned with the direction of cone rotation, the chisel crest presents a relatively narrow cutting profile to the uncut formation. The narrow profile may enhance the depth of formation penetration but, like a conical insert, it typically is not able to remove formation material as quickly as a wider cutting profile. On the other hand, when a chisel-shaped insert is positioned in the rolling cone cutter with its elongate chisel crest perpendicular to the direction of cone rotation, the chisel crest presents a relatively wide cutting profile to the uncut formation. The relatively wide cutting profile tends to increase the width of the path swept by the insert, however, the wide, blunt profile of the crest may reduce formation penetration.

As will be understood then, there remains a need in the art for a cutter element and cutting structure that will provide a high rate of penetration, a high rate of formation removal, and be durable enough to withstand hard and abrasive formations.

SUMMARY OF THE PREFERRED EMBODIMENTS

In accordance with at least one embodiment, a cutter element for a drill bit comprises a base portion having a diameter and a central axis. In addition, the cutter element comprises a cutting portion extending from the base portion and defining an extension height. The cutting portion includes a first pair of flanking surfaces that taper towards one another to form a first elongate chisel crest, and a second pair of flanking surfaces that taper towards one another to form a second elongate chisel crest that intersects the first elongate chisel crest in top view. Further, the first elongate chisel crest defines a first crest tangent angle in front profile view. The first crest tangent angle at 10% of the diameter measured radially from the central axis on the first elongate chisel crest in profile view is greater than 75° and less than or equal to 90°.

In accordance with other embodiments, a cutter element for a drill bit comprises a base portion. In addition, the cutter element comprises a cutting portion extending from the base portion and defining an extension height. The cutting portion comprises a first elongate chisel crest and a second elongate chisel crest that crosses the first elongate chisel crest. Further, at least a portion of each of the first elongate chisel crest and the second elongate chisel crest extend to the extension height. Moreover, the first elongate chisel crest includes a first crest end and a second crest end, and is continuously curved therebetween in front profile view.

In accordance with still other embodiments, a drill bit for cutting a borehole having a borehole sidewall, corner and bottom, comprises a bit body including a bit axis. In addition, the drill bit comprises a rolling cone cutter mounted on the bit body and adapted for rotation about a cone axis. Further, the drill bit comprises at least one cutter element having a base portion with a diameter secured in the rolling cone cutter and a cutting portion extending therefrom. The cutting portion comprising a first pair of flanking surfaces that taper towards one another to form a first elongate chisel crest, and a second pair of flanking surfaces that taper towards one another to form a second elongate chisel crest that intersects the first elongate chisel crest in top view. Moreover, the first elongate chisel crest defines a first crest tangent angle in front profile view. The first crest tangent angle at 10% of the diameter measured radially from the central axis on the first elongate chisel crest in profile view is greater than 75° and less than or equal to 90°.

Thus, the embodiments described herein comprise a combination of features and characteristics which are directed to overcoming some of the shortcomings of prior bits and cutter element designs. The various characteristics described above, as well as other features, will be readily apparent to those skilled in the art upon reading the following detailed description of the preferred embodiments, and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENTS

Figure 1:
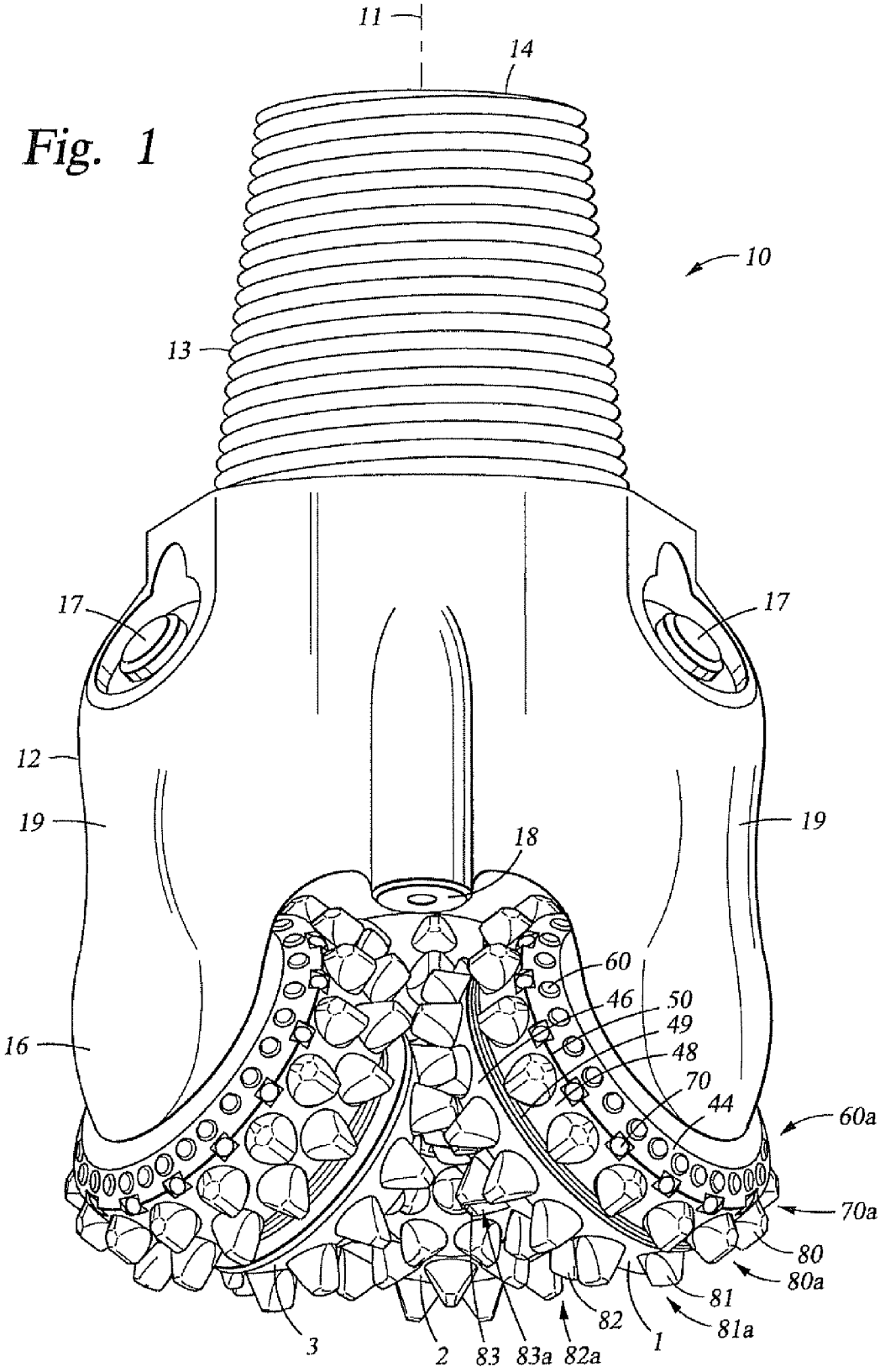
FIG. 1 is a perspective view of an earth-boring bit.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form, and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices and connections.

Referring first to FIG. 1, an earth-boring bit 10 is shown to include a central axis 111 and a bit body 12 having a threaded pin section 13 at its upper end that is adapted for securing the bit to a drill string (not shown). The uppermost end will be referred to herein as pin end 14. Bit 10 has a predetermined gage diameter as defined by the outermost reaches of three rolling cone cutters 1, 2, 3 which are rotatably mounted on bearing shafts that depend from the bit body 12. Bit body 12 is composed of three sections or legs 19 (two shown in FIG. 1) that are welded together to form bit body 12. Bit 10 further includes a plurality of nozzles 18 that are provided for directing drilling fluid toward the bottom of the borehole and around cone cutters 1-3. Bit 10 includes lubricant reservoirs 17 that supply lubricant to the bearings that support each of the cone cutters. Bit legs 19 include a shirttail portion 16 that serves to protect the cone bearings and cone seals from damage as might be caused by cuttings and debris entering between leg 19 and its respective cone cutter.

Figure 2:
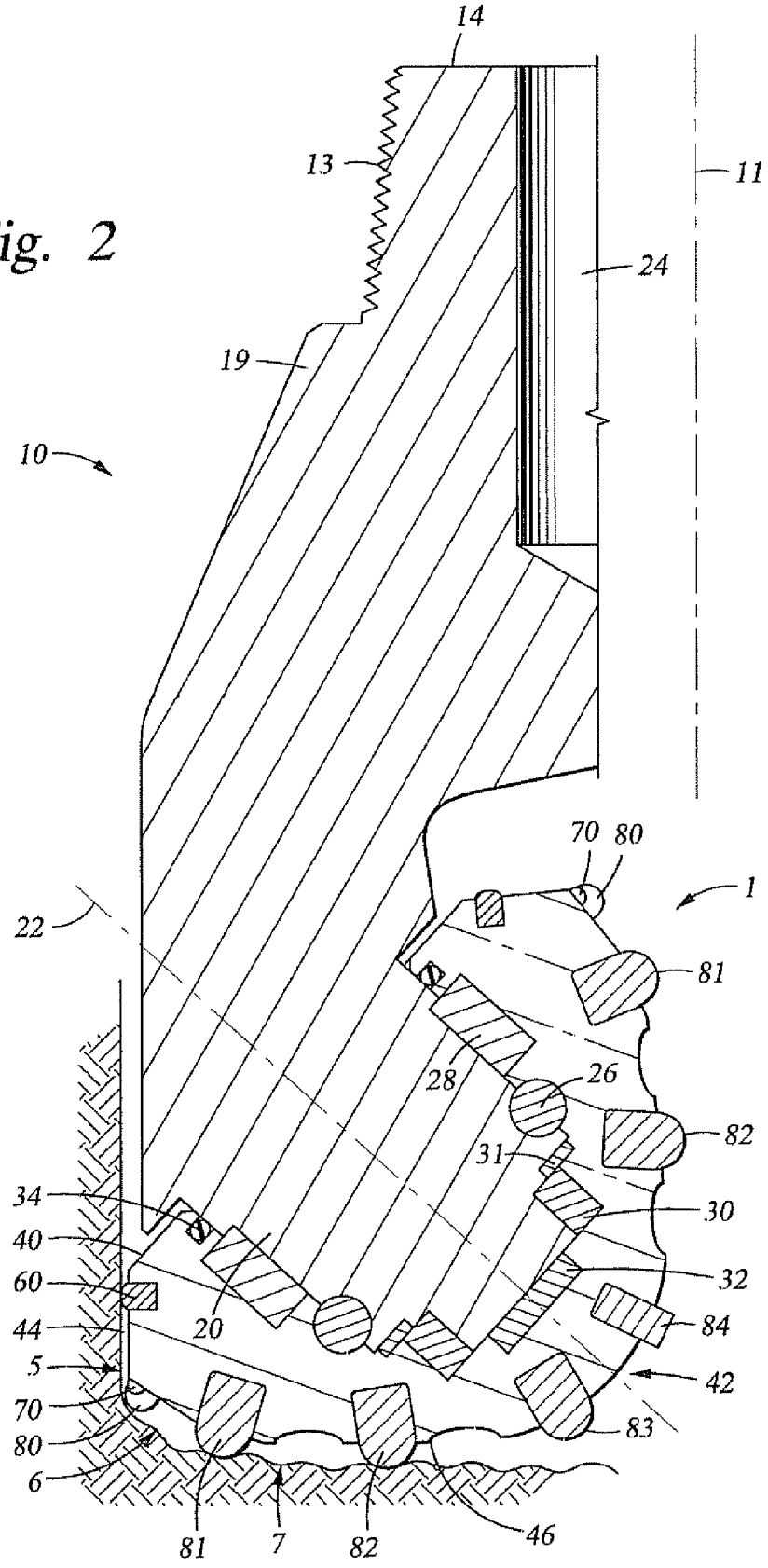
FIG. 2 is a partial section view take through one leg and one rolling cone cutter of the bit shown in FIG. 1.

Referring now to both FIGS. 1 and 2, each cone cutter 1-3 is mounted on a pin or journal 20 extending from bit body 12, and is adapted to rotate about a cone axis of rotation 22 oriented generally downwardly and inwardly toward the center of the bit. Each cutter 1-3 is secured on pin 20 by locking balls 26, in a conventional manner. In the embodiment shown, radial and axial thrust are absorbed by roller bearings 28, 30, thrust washer 31 and thrust plug 32. The bearing structure shown is generally referred to as a roller bearing; however, the invention is not limited to use in bits having such structure, but may equally be applied in a bit where cone cutters 1-3 are mounted on pin 20 with a journal bearing or friction bearing disposed between the cone cutter and the journal pin 20. In both roller bearing and friction bearing bits, lubricant may be supplied from reservoir 17 to the bearings by apparatus and passageways that are omitted from the figures for clarity. The lubricant is sealed in the bearing structure, and drilling fluid excluded therefrom, by means of an annular seal 34 which may take many forms. Drilling fluid is pumped from the surface through fluid passage 24 where it is circulated through an internal passageway (not shown) to nozzles 18 (FIG. 1). The borehole created by bit 10 includes sidewall 5, corner portion 6 and bottom 7, best shown in FIG. 2.

Referring still to FIGS. 1 and 2, each cone cutter 1-3 includes a generally planar backface 40 and nose portion 42. Adjacent to backface 40, cutters 1-3 further include a generally frustoconical surface 44 that is adapted to retain cutter elements that scrape or ream the sidewalls of the borehole as the cone cutters rotate about the borehole bottom. Frustoconical surface 44 will be referred to herein as the "heel" surface of cone cutters 1-3. It is to be understood, however, that the same surface may be sometimes referred to by others in the art as the "gage" surface of a rolling cone cutter.

Extending between heel surface 44 and nose 42 is a generally conical surface 46 adapted for supporting cutter elements that gouge or crush the borehole bottom 7 as the cone cutters rotate about the borehole. Frustoconical heel surface 44 and conical surface 46 converge in a circumferential edge or shoulder 50, best shown in FIG. 1. Although referred to herein as an "edge" or "shoulder," it should be understood that shoulder 50 may be contoured, such as by a radius, to various degrees such that shoulder 50 will define a contoured zone of convergence between frustoconical heel surface 44 and the conical surface 46. Conical surface 46 is divided into a plurality of generally frustoconical regions or bands 48 generally referred to as "lands" which are employed to support and secure the cutter elements as described in more detail below. Grooves 49 are formed in cone surface 46 between adjacent lands 48.

In the bit shown in FIGS. 1 and 2, each cone cutter 1-3 includes a plurality of wear resistant cutter elements in the form of inserts which are disposed about the cone and arranged in circumferential rows in the embodiment shown. More specifically, rolling cone cutter 1 includes a plurality of heel inserts 60 that are secured in a circumferential row 60*a* in the frustoconical heel surface 44. Cone cutter 1 further includes a first circumferential row 70*a* of gage inserts 70 secured to cone cutter 1 in locations along or near the circumferential shoulder 50. Additionally, the cone cutter includes a second circumferential row 80*a* of gage inserts 80. The cutting surfaces of inserts 70, 80 have differing geometries, but each extends to full gage diameter. Row 70*a* of the gage inserts is sometimes referred to as the binary row and inserts 70 sometimes referred to as binary row inserts. The cone cutter 1 further includes inner row inserts 81, 82, 83 secured to cone surface 46 and arranged in concentric, spaced-apart inner rows 81*a*, 82*a*, 83*a*, respectively. Heel inserts 60 generally function to scrape or ream the borehole sidewall 5 to maintain the borehole at full gage and prevent erosion and abrasion of the heel surface 44. Gage inserts 80 function primarily to cut the corner of the borehole. Binary row inserts 70 function primarily to scrape the borehole wall and limit the scraping action undertaken by gage inserts 80, thereby preventing gage inserts 80 from wearing as rapidly as might otherwise occur. Inner row cutter elements 81, 82, 83 of inner rows 81*a*, 82*a*, 83*a* are employed to gouge and remove formation material from the remainder of the borehole bottom 7. Insert rows 81*a*, 82*a*, 83*a* are arranged and spaced on rolling cone cutter 1 so as not to interfere with rows of inner row cutter elements on the other cone cutters 2, 3. Cone 1 is further provided with relatively small "ridge cutter" cutter elements 84 in nose region 42 which tend to prevent formation build-up between the cutting paths followed by adjacent rows of the more aggressive, primary inner row cutter elements from different cone cutters. Cone cutters 2 and 3 have heel, gage and inner row cutter elements and ridge cutters that are similarly, although not identically, arranged as compared to cone 1. The arrangement of cutter elements differs as between the three cones in order to maximize borehole bottom coverage, and also to provide clearance for the cutter elements on the adjacent cone cutters.

In the embodiment shown, inserts 60, 70, 80-83 each include a generally cylindrical base portion, a central axis, and a cutting portion that extends from the base portion, and further includes a cutting surface for cutting the formation material. The base portion is secured by interference fit into a mating socket drilled into the surface of the cone cutter.

A cutter element 100 is shown in FIGS. 3-6 and is believed to have particular utility when employed as an inner row cutter element, such as in inner rows 81*a* or 82*a* shown in FIGS. 1 and 2 above. However, cutter element 100 may also be employed in other rows and other regions on the cone cutter, such as in heel row 60*a* and gage rows 70*a*, 70*b* shown in FIGS. 1 and 2.

Figure 4:
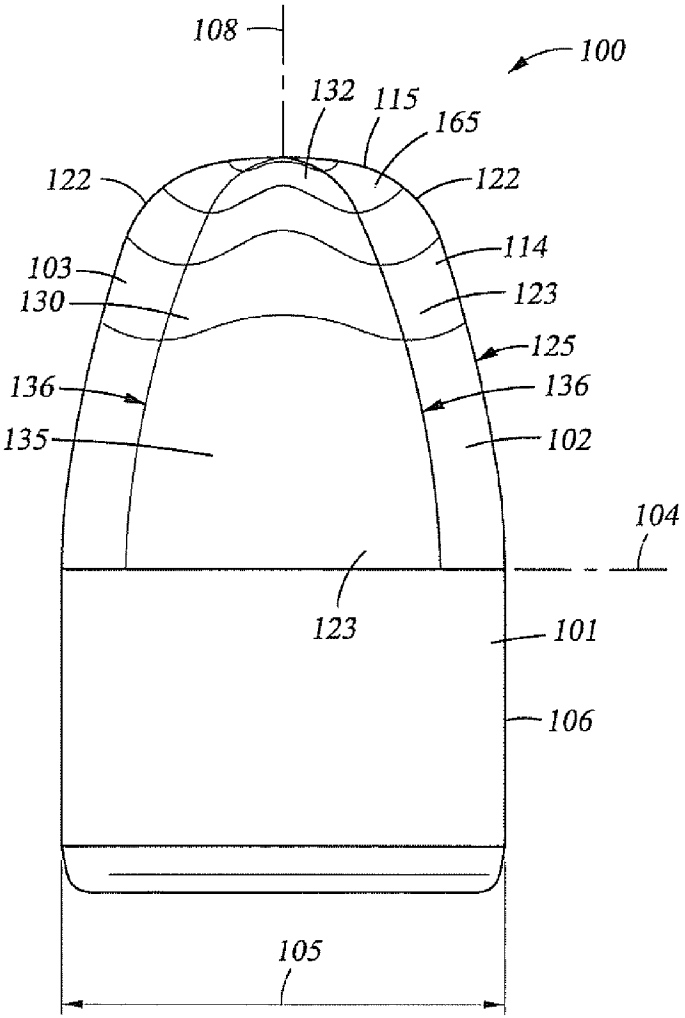
FIG. 4 is a front elevation view of the cutter element shown in FIG. 3.
Figure 3:
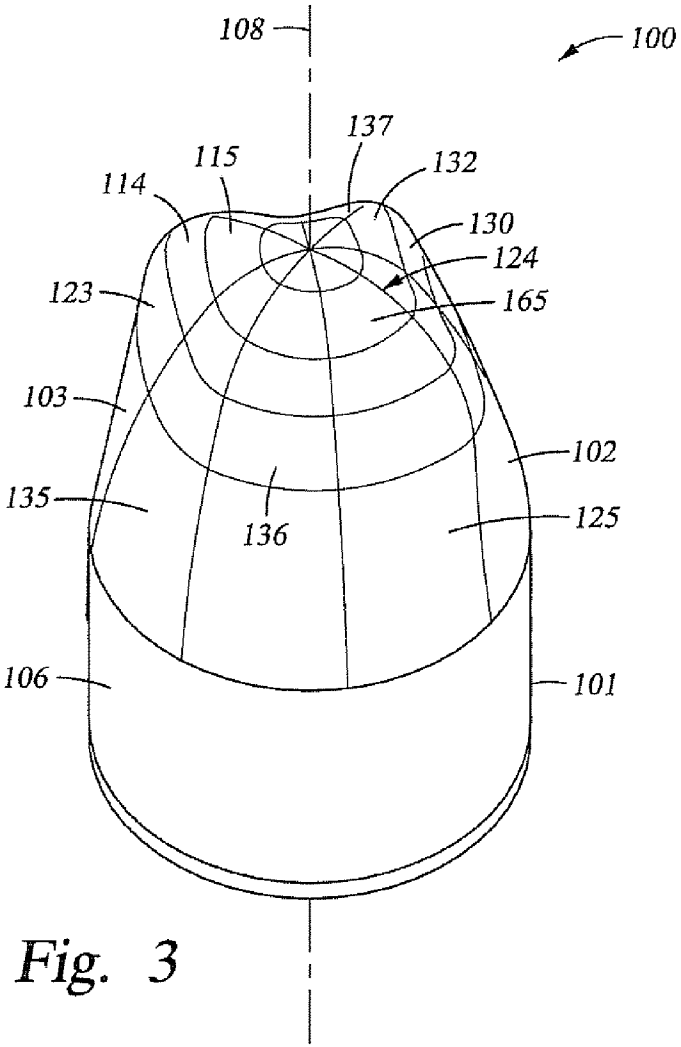
FIG. 3 is a perspective view of an embodiment of a cutter element having particular application in a rolling cone bit such as that shown in FIGS. 1 and 2.
Figure 5:
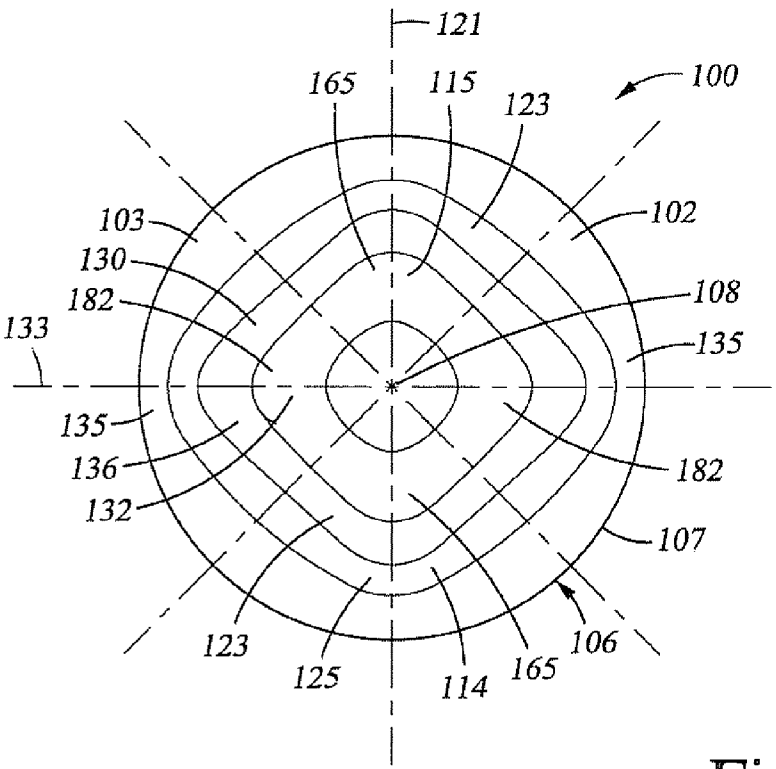
FIG. 5 is a top view of the cutter element shown in FIG. 3.

Referring now to FIGS. 3-6, cutter element or insert 100 is shown to include a base portion 101 and a cutting portion 102 extending therefrom. Cutting portion 102 includes a cutting surface 103 extending from the reference plane of intersection 104 that divides base 101 and cutting portion 102. In this embodiment, base portion 101 is generally cylindrical, having a diameter 105, a central axis 108, and an outer cylindrical surface 106 defining an outer circular profile or footprint 107 of the insert (FIG. 5).

Figure 6:
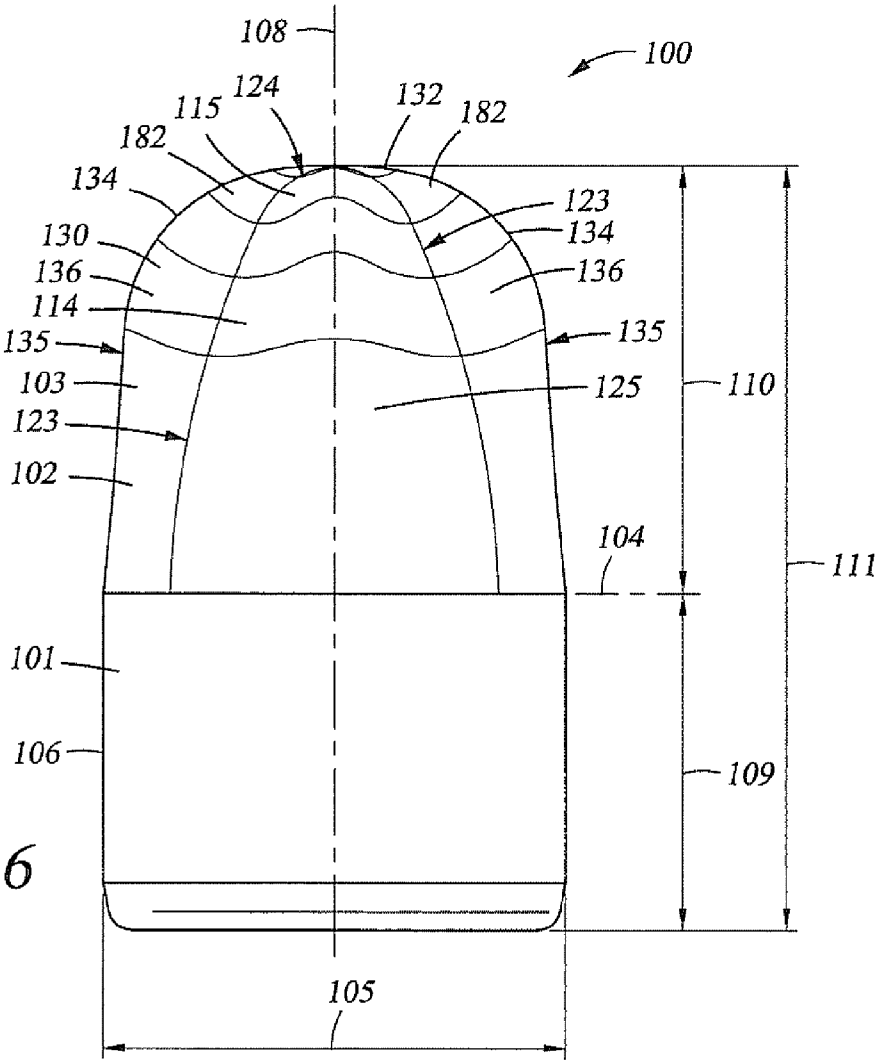
FIG. 6 is a side elevation view of the cutter element shown in FIG. 3.

As best shown in FIG. 6, base portion 101 has a height 109, and cutting portion 102 extends from base portion 101 so as to have an extension height 110. Collectively, base 101 and cutting portion 102 define the insert's overall height 111. Base portion 101 may be formed in a variety of shapes other than cylindrical. As conventional in the art, base portion 101 is preferably retained within a rolling cone cutter by interference fit, or by other means, such as brazing or welding, such that cutting portion 102 and cutting surface 103 extend beyond the cone steel. Once mounted, the extension height 110 of the cutter element 100 is generally the distance from the cone surface to the outermost point or portion of cutting surface 103 as measured perpendicular to the cone surface and generally parallel to the insert's axis 108.

Referring still to FIGS. 3-6, cutting portion 102 generally includes a first chisel structure 114 and a second chisel structure 130 that terminate in crossing chisel crests 115, 132, respectively. In this embodiment, first chisel structure 114 and second chisel structure 130 generally extend along insert axis 108 to substantially the same extension height 110.

Chisel structure 114 includes a pair of flanking surfaces 123 that taper or incline towards one another and intersect at chisel crest 115 in a peaked ridge 124, best shown in FIGS. 4 and 6. Peaked ridge 124 extends generally linearly along a crest median line 121 (FIG. 5). As best shown in the profile view of FIG. 6, peaked ridge 124 is generally arcuate or curved (i.e., non-linear) along its upper surface. In particular, elongate chisel crest 115 extends between crest ends 122, and is slightly convex therebetween (FIG. 4). In this embodiment, chisel crest 115 is highest at the point that it intersects insert axis 108, at extension height 110. Crest 115 also includes crest end surfaces 125 (FIG. 6) which are generally frustoconical as they extend from insert base 101 up to crest end 122 generally between flanking surfaces 123. In this embodiment, crest ends 122 are partial spheres defined by spherical radii, with the radius of each end 122 being identical. As described in examples below, in other embodiments, the crest ends need not be spherical and/or may not be of uniform size.

Crest structure 130 is substantially identical to crest structure 114, and includes a pair of flanking surfaces 136 that taper or incline towards one another and intersect at chisel crest 132 in a peaked ridge 137. Peaked ridge 137 and elongate chisel crest 132 extend generally linearly along crest median line 133 and terminate at crest ends 134. Crest ends 134 include end surfaces 135 which are generally frustoconical and extend from base 101 to crest end 134. Crest ends 134 present partial spherical surfaces defined by spherical radii, where the radius of each end 134 is identical in this embodiment. Flanking surfaces 136, along with peaked ridge 137, define a crest end profile as best shown in FIG. 4. In profile view looking perpendicular to insert axis 108, crest 132 is slightly convex and is highest at the point that it intersects insert axis 108.

In the embodiment shown in FIGS. 3-6, second chisel crest 132 extending along second crest median line 133 is substantially perpendicular to first chisel crest 115 extending along crest median line 121 (FIG. 5). In addition, in this embodiment, each elongate chisel crest 115, 132 generally bisects the other chisel crest, such that each crest 115, 132 may be described as including a pair of crest segments 165, 182, respectively.

As viewed in the front and side profile views of FIGS. 4 and 6, respectively, elongate chisel crests 115, 132 are each slightly convex between crest ends 122, 134. Preferably, and contrary to many conical inserts, the slightly convex profiles of chisel crests 115, 132 forming cutting portion 102 do not include a sharp point or apex. Rather, the slightly convex profile of each chisel crest 115, 132 results in a relatively broad and blunt cutting profile formed by the two, elongate and relatively flat chisel crests 115, 132.

The degree of curvature of a chisel crest in profile view may be described by a crest tangent angle measured between the insert axis and a line tangent to the chisel crest profile, taken at a particular point along the chisel crest profile. Thus, as used herein, the phrase "crest tangent angle" may be used to refer to the angle between the insert axis and a tangent to the chisel crest profile, at a particular point along the chisel crest in profile view. For example, referring now to FIG. 7, a tangent line $T_{115}$ to the profile of elongate chisel crest 115, taken at a point $P_{115}$ located at a radial distance $d_{115}$ (measured radially from insert axis 108) along the profile of crest 115, forms a crest tangent angle $\alpha$ with insert axis 108. Tangent line $T_{115}$ may be taken at any point $P_{115}$ along the profile of chisel crest 115. It should be appreciated that for a crest that is curved in profile view (i.e., not flat) the crest tangent angle will vary with location along the crest profile. In this embodiment, crest tangent angle $\alpha$ ranges from 90° at insert axis 108 (at a radial distance $d_{115}$ of zero) to about 83° at 10% of diameter 105 (at a radial distance $d_{115}$ of 10% of diameter 105), about 79° at 15% of diameter 105 (at a radial distance $d_{115}$ of 15% of diameter 105), and about 70° at 20% of diameter 105 (at a radial distance $d_{115}$ of 20% of diameter 105). Likewise, referring now to FIG. 8, a tangent line $T_{132}$ to the profile of elongate chisel crest 132, taken at a point $P_{132}$ located at a radial distance $d_{132}$ (measured radially from insert axis 108) along the profile of crest 132, forms a crest tangent angle $\beta$ with insert axis 108. In this embodiment, crest tangent angle $\beta$ also ranges from 90° at insert axis 108 (at a radial distance $d_{132}$ of zero) to about 83° at 10% of diameter 105 (at a radial distance $d_{132}$ of 10% of diameter 105), 79° at 15% of diameter 105 (at a radial distance $d_{132}$ of 15% of diameter 105), and about 70° at 20% of diameter 105 (at a radial distance $d_{132}$ of 20% of diameter 105). It should be appreciated that for a generally convex elongate chisel crest, the crest tangent angle will generally decease moving away from the insert axis. In addition, it should be appreciated that the closer the crest tangent angle is to 90°, the flatter the elongate crest profile in the region about the point where the crest tangent angle is measured.

Figure 7:
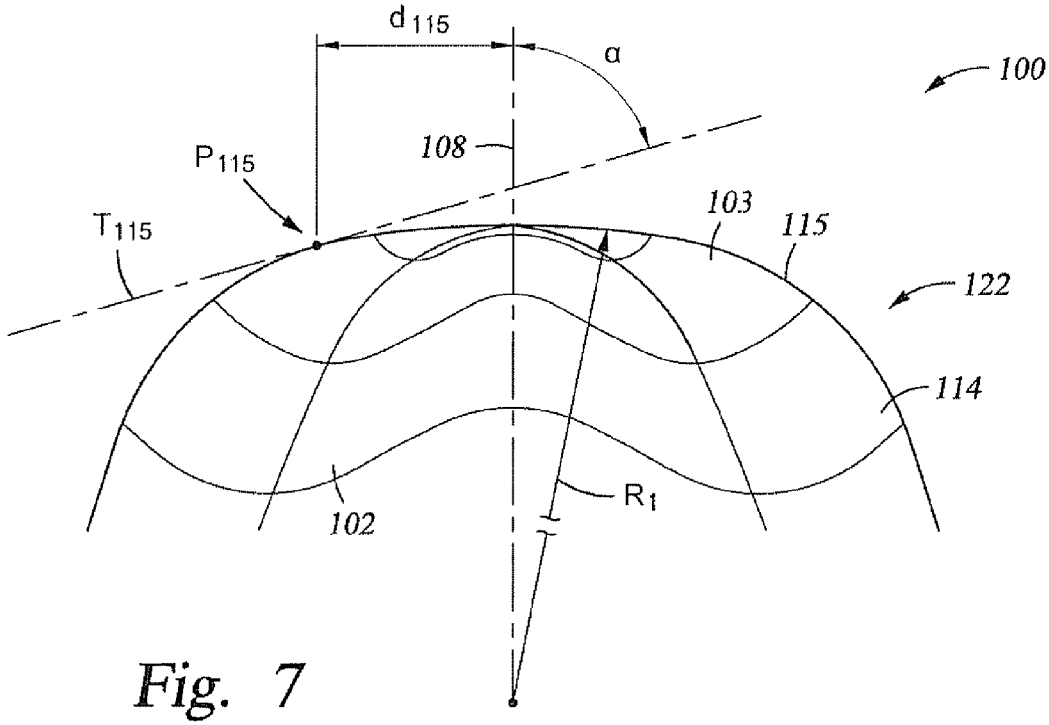
FIG. 7 is an enlarged front elevation view of the elongate chisel crests of the cutter element shown in FIG. 3.
Figure 8:
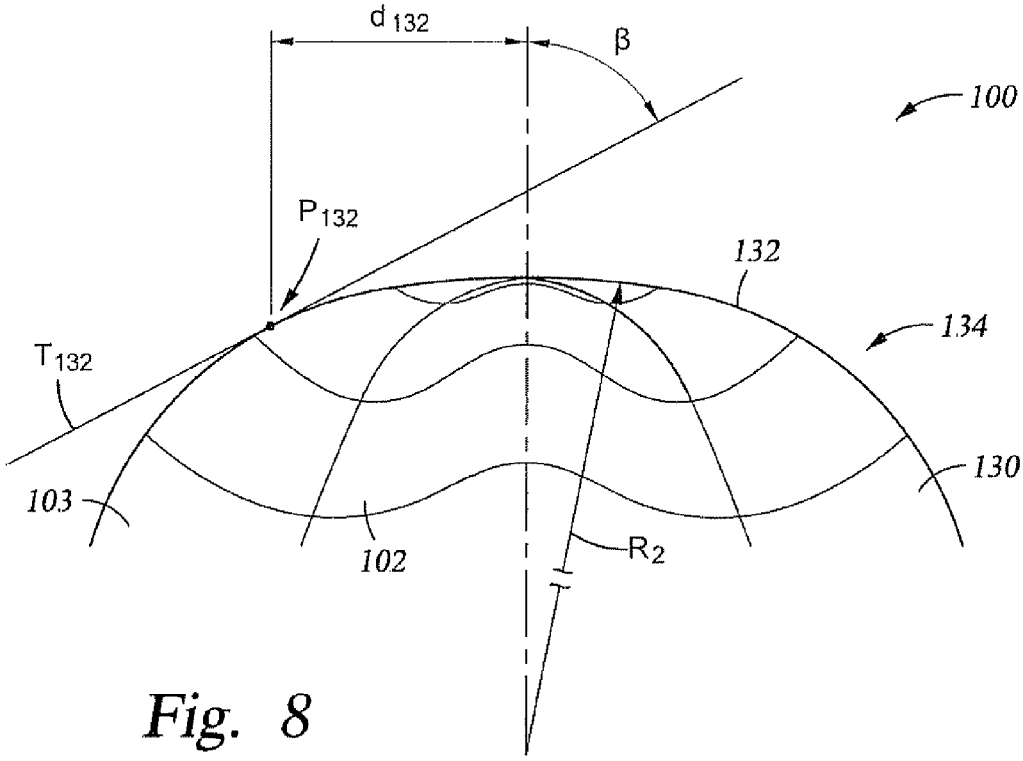
FIG. 8 is an enlarged side elevation view of the elongate chisel crests of the cutter element shown in FIG. 3.

In other embodiments, the profile of each elongate chisel-shaped crest 115, 132 may be more convex and curved than shown in FIGS. 7 and 8, or it may be flatter and thus less convex. However, the crossing chisel-shaped crests (e.g., crossing chisel crests 115, 132) are preferably free of sharp points or cutting tips. In addition, the crossing chisel-shaped crests preferably have a crest tangent angle (e.g., crest tangent angle $\alpha$, $\beta$) between 75° and 90° at any point P (e.g., point $P_{115}$, point $P_{132}$) along the crest profile between the insert axis (e.g., insert axis 108) and 10% of the insert diameter (e.g., diameter 105), a crest tangent angle between 65° and 90° as measured at any point P along the crest profile between the insert axis and 15% of the insert diameter, and a crest tangent angle between 55° and 90° as measured at any point P along the crest profile between the insert axis and 20% of the insert diameter.

Referring still to FIGS. 7 and 8, the curvature of the profile of crests 115, 132 between crest ends 122, 134 may also be described by a longitudinal radius of curvature $R_1$, $R_2$, respectively. As used herein, the phrase "longitudinal radius of curvature" may be used to refer to the radius of curvature of an elongate crest between its crest ends in profile view. In general, the greater the longitudinal radius of curvature, the "flatter" the crest between its ends. In the embodiment shown in FIGS. 7 and 8, the ratio of longitudinal radius of curvature $R_1$ to extension height 110 is about 0.9. In addition, in this embodiment, the ratio of longitudinal radius of curvature $R_2$ to extension height 110 is also about 0.9. Although the longitudinal radius of curvature $R_2$ of crest 132 is substantially the same as longitudinal radius of curvature $R_1$ of crest 115, in other embodiments, in general, the longitudinal radii of curvature of crossing-crests may be the identical or different. To achieve a chisel-shaped crest and associated potential benefits, the ratio of the longitudinal radius of curvature $R_1$, $R_2$ of elongate chisel crest 115, 132, respectively, to extension height 110 of insert 100 is preferably greater than 0.7, and more preferably between 0.7 and 1.8.

Referring again to FIGS. 3-6, cutting surface 103 formed by intersecting chisel structures 114, 130 also includes relatively shallow valley portions 150 extending from base portion 101 to crests 115, 132 between the adjacent flanking surfaces 123, 136. Valleys 150 smoothly blend flanking surfaces 123, 136, and provide a transition surface between flanking surfaces 123, 136. Valleys 150 are preferably formed to eliminate sharp or abrupt changes in radius at the lowermost sections of cutting portion 102. Valleys 150 are preferably smoothly curved so as to be free of sharp edges and transitions having small radii (0.08 in. or less).

In the embodiment of FIGS. 3-6, cutting surface 103 is preferably a continuously contoured surface. As used herein, the term "continuously contoured" means and relates to surfaces that can be described as having continuously curved surfaces that are free of relatively small radii (0.08 in. or smaller) as have conventionally been used to break sharp edges or round off transitions between adjacent distinct surfaces. Although certain reference or contour lines are shown in FIGS. 3-6 to represent general transitions between one surface and another, it should be understood that the lines do not represent sharp transitions. Instead, all surfaces are preferably blended together to form the preferred continuously contoured surface and cutting profiles that are free from abrupt changes in radius. By eliminating small radii along cutting surface 103, detrimental stresses in the cutting surface are reduced, leading to a more durable and longer lasting cutter element.

Figure 9:
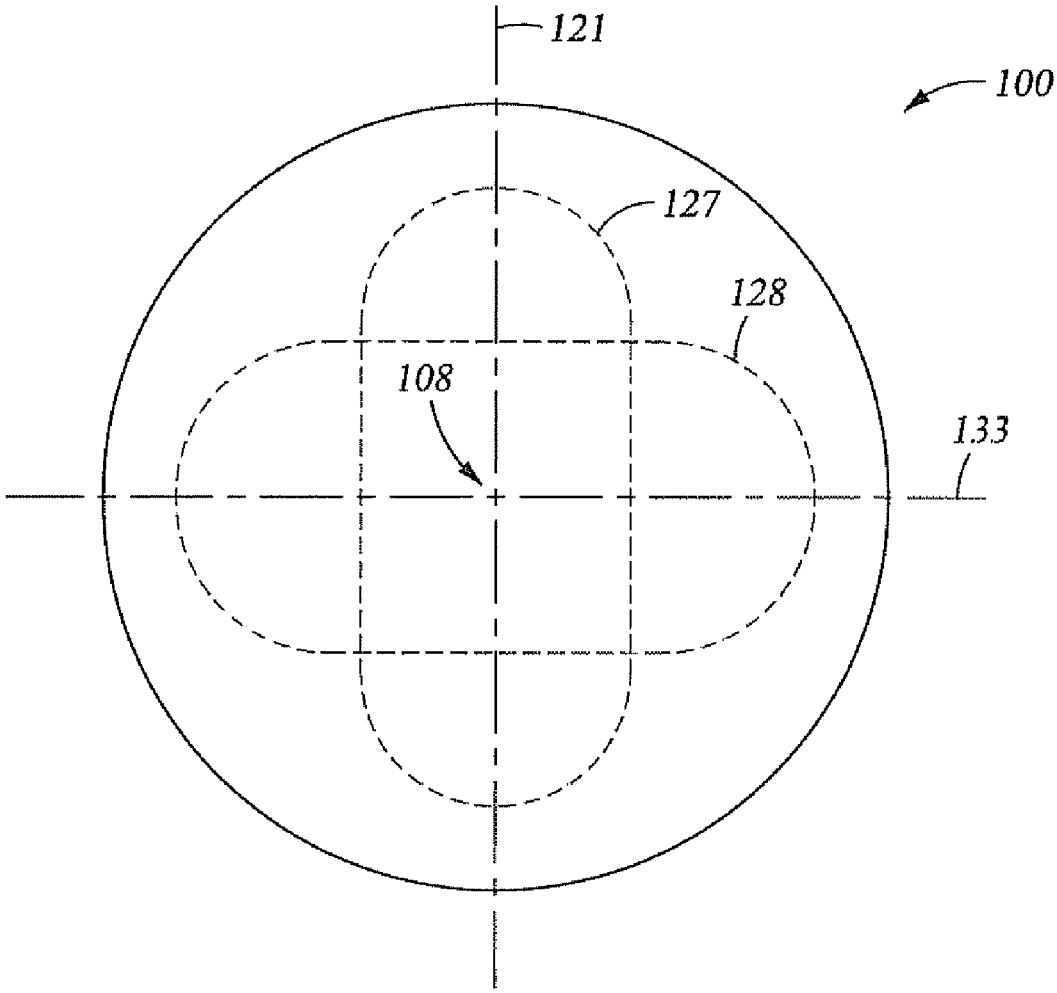
FIG. 9 is a schematic top view of the cutter element shown in FIGS. 3-6.

Referring now to FIG. 9, a top view of insert 100 like that illustrated in FIG. 5 is shown, however, in FIG. 9, dashed lines 127, 128 schematically represent what is referred to herein as the top profile of chisel crests 115, 132, respectively. More particularly, line 127 represents the elongate and generally racetrack shape corresponding to the top profile of crest 115; line 127 is generally shown at the intersection between flanking surfaces 123 and peaked ridge 124 and lies in a plane perpendicular to insert axis 108. Likewise, line 128 represents elongate and generally racetrack shape corresponding to the top profile of the chisel crest 132; line 128 is generally shown at the intersection between flanking surfaces 136 and peaked ridge 137 and lies in a plane perpendicular to insert axis 108. Comparing the top profiles 127, 128 as shown in FIG. 7, chisel crests 115, 132 are substantially perpendicular to each other, and further, chisel crest 115, 132 generally bisect one another.

Figure 10:
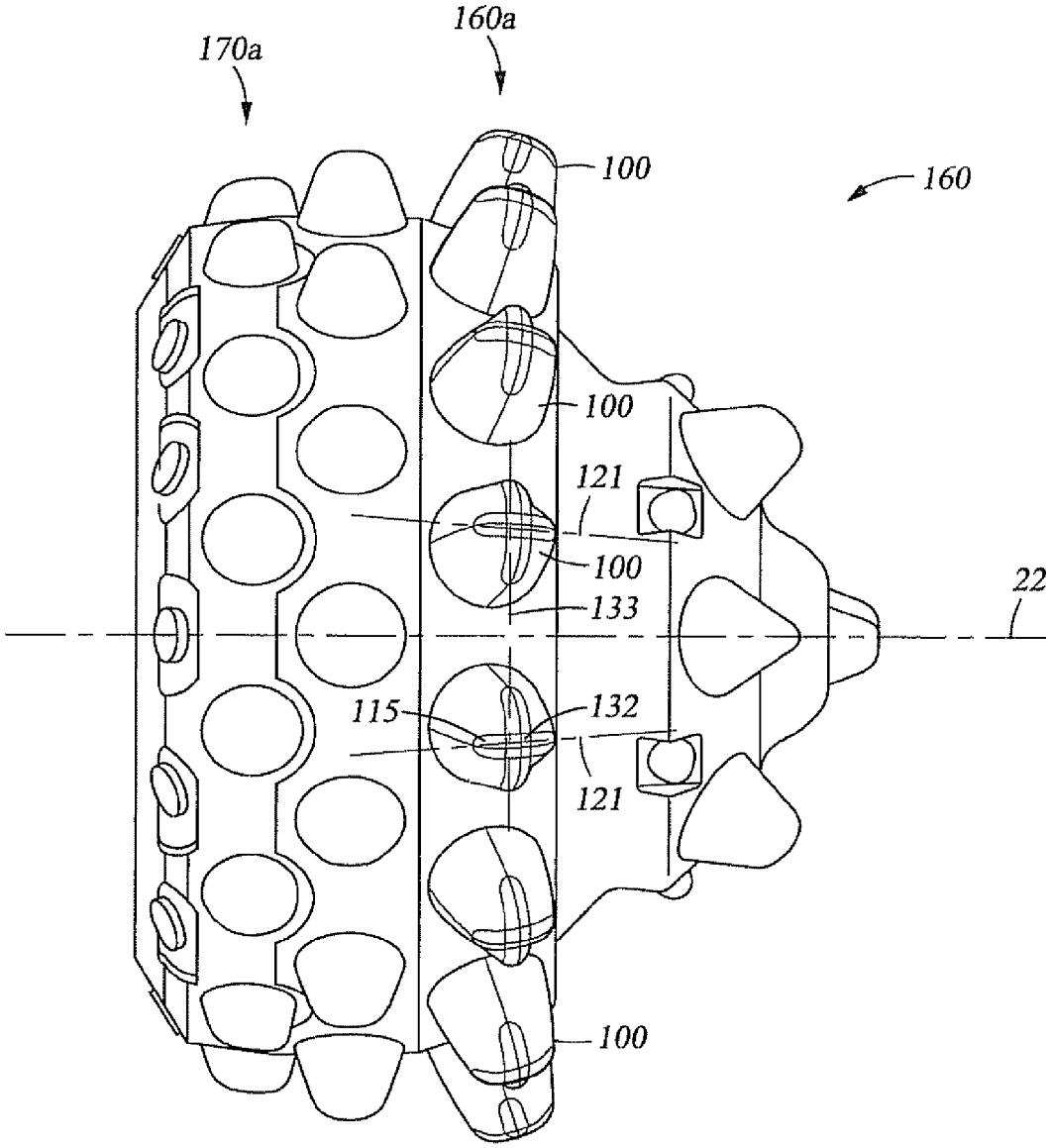
FIG. 10 is a perspective view of a rolling cone cutter having the cutter element of FIGS. 3-6 mounted therein.

Referring now to FIG. 10, insert 100 thus described is shown mounted in a rolling cone cutter 160 as may be employed, for example, in the bit 10 described above with reference to FIGS. 1 and 2, with cone cutter 160 substituted for any of the cones 1-3 previously described. As shown, cone cutter 160 includes a plurality of inserts 100 disposed in a circumferential inner row 160*a*. In this embodiment, inserts 100 are all oriented such that a projection of crest median line 121 intersects cone axis 22. Inserts 100 may be positioned in rows of cone cutter 160 in addition to or other than inner row 160*a*, such as in gage row 170*a*. Likewise, inserts 100 may be mounted in other orientations, such as in an orientation where a projection of the crest median line 121 is skewed relative to the cone axis 22.

As understood by those in the art, the phenomenon by which formation material is removed by the impacts of cutter elements is extremely complex. The geometry and orientation of the cutter elements, the design of the rolling cone cutters, the type of formation being drilled, as well as other factors, all play a role in how the formation material is removed and the rate at which the formation material is removed (i.e., ROP).

Depending upon their location in the rolling cone cutter, cutter elements have different cutting trajectories as the cone rotates in the borehole. Cutter elements in certain locations of the cone cutter may have more than one cutting mode. In addition to a scraping or gouging motion, some cutter elements include a twisting motion as they enter into and then separate from the formation. As such, the cutter elements 100 may be oriented to optimize cutting and formation removal as the cutter elements 100 both scrape and twist against the formation.

The impact of a cutter element with the borehole bottom will typically penetrate the formation and remove a first volume of formation material and, in addition, will tend to cause cracks to form in the formation immediately below and lateral to the material that has been removed. These cracks, in turn, allow for easier removal of the now-fractured material by the impact from other cutter elements on the bit that subsequently impact the formation. Without being held to this or any other particular theory, it is believed that an insert such as insert 100 intersecting chisel structures and chisel crests, as described above, will enhance formation removal by increasing the propagation of cracks in the uncut formation as compared to a single chisel-shaped crest of an insert of similar design and size lacking crossing crests.

Referring now to FIGS. 11-14, a cutter element 200 is shown. Cutter element 200 is believed to have particular utility when employed as an inner row cutter element, such as in inner rows 81*a* or 82*a* shown in FIGS. 1 and 2 above. However, cutter element 200 may also be employed in other rows and other regions on the cone cutter, such as in heel row 60*a* and gage rows 70*a*, 70*b* shown in FIGS. 1 and 2.

Cutter element or insert 200 includes a base portion 201, substantially identical to base 101 previously described, and a cutting portion 202 having a cutting face 203 extending therefrom. Cutting surface 203 is preferably continuously contoured. Base portion 201 has a central axis 208.

Referring still to FIGS. 11-14 cutting portion 202 includes a first chisel structure 214 and a second chisel structure 230 that terminate in crossing elongate chisel crests 215, 232, respectively. In this embodiment, first chisel structure 214 and second chisel structure 230 generally extend along insert axis 208 to substantially the same extension height.

Figure 12:
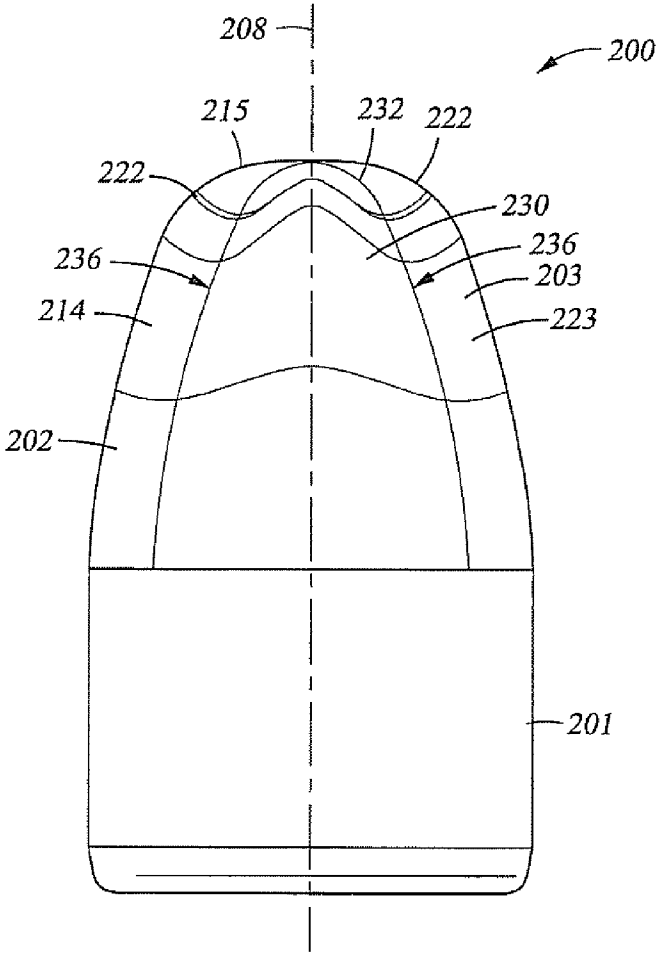
FIG. 12 is a front elevation view of the cutter element shown in FIG. 11.
Figure 11:
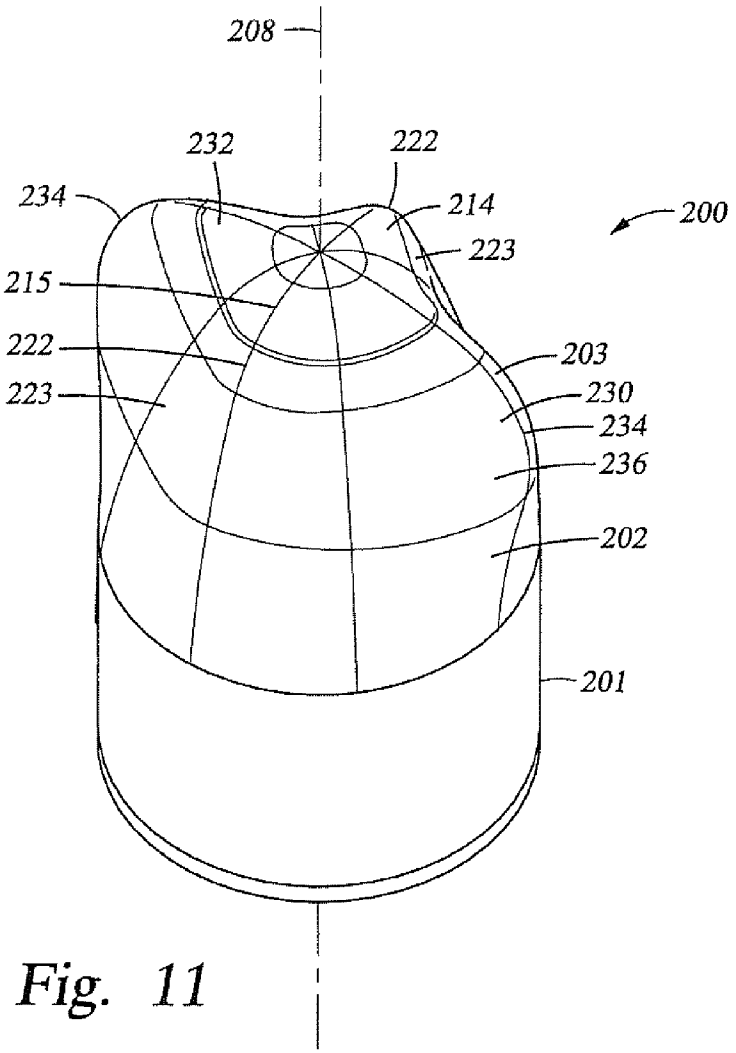
FIG. 11 is a perspective view of an embodiment of a cutter element having particular application in a rolling cone bit, such as that shown in FIGS. 1 and 2.
Figure 14:
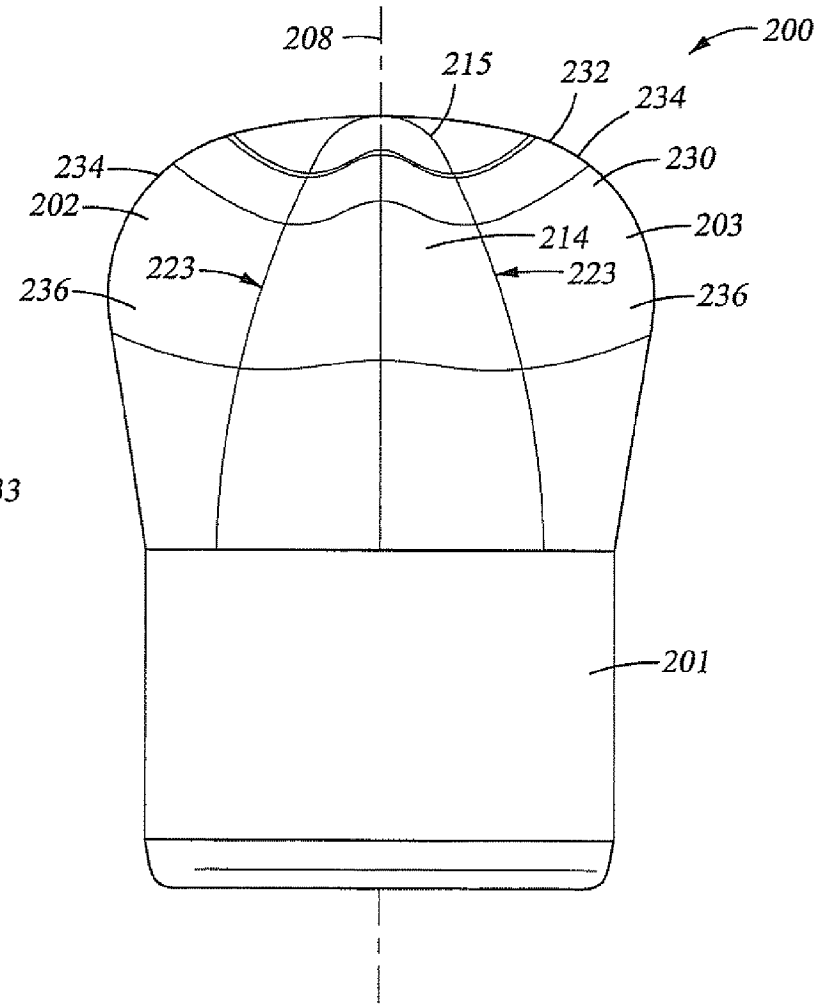
FIG. 14 is a side elevation view of the cutter element shown in FIG. 11.
Figure 13:
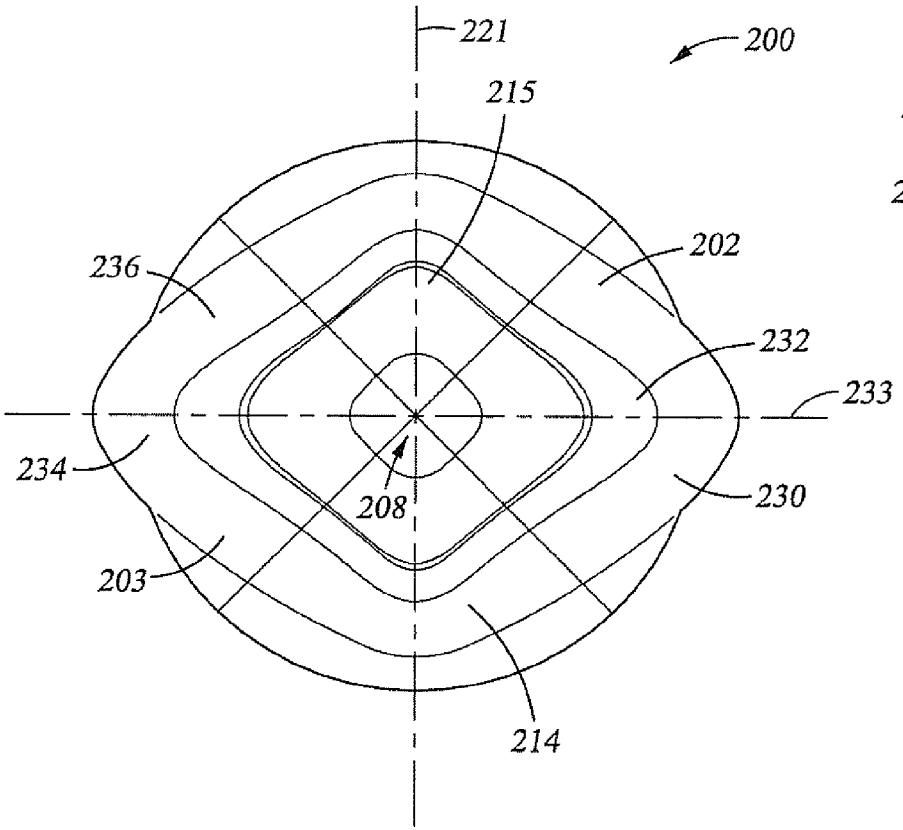
FIG. 13 is a top view of the cutter element shown in FIG. 11.

Chisel structure 214 includes a pair of flanking surfaces 223 that taper or incline towards one another and intersect at chisel crest 215, best shown in FIGS. 12 and 14. Chisel crest 215 extends generally linearly along a crest median line 221 (FIG. 13). Elongate chisel crest 215 extends between crest ends 222, and in profile view, is slightly convex therebetween (FIG. 12).

Likewise, crest structure 230 includes a pair of flanking surfaces 236 that taper or incline towards one another and intersect at chisel crest 232. Elongate chisel crest 232 extends generally linearly along crest median line 233 and terminates at crest ends 234. In profile view looking perpendicular to insert axis 208, crest 232 is slightly convex and is highest at the point that it intersects insert axis 208.

In the embodiment shown in FIGS. 11-14, second crest 232 extending along second crest median line 233 is substantially perpendicular to first crest 215 extending along crest median line 221 (FIG. 13). In addition, in this embodiment, each elongate chisel crest 215, 232 generally bisects the other chisel crest, such that each crest 215, 232 into substantially equal halves.

The primary difference between insert 100 previously described with reference to FIGS. 3-6 and insert 200 is that cutting portion 202 of insert 200 includes a chisel structure 230 that including crest 232 having a longer crest length than that of crest 215 of chisel structure 214. Comparing the front and side profiles of insert 200 shown in FIGS. 12 and 14, respectively, the length of chisel structure 230 and crest 232 exceeds the length of chisel structure 214 and crest 215. Further, in this embodiment, the profile of chisel structure 230 extends beyond the diameter of base portion 201.

As viewed in the front and side profile views of FIGS. 12 and 14, respectively, each elongate chisel crest 215, 232 is slightly convex between crest ends 222, 234. As with the embodiment shown in FIGS. 3-6, cutting surface 203 of insert 200 is free of a sharp point or apex and instead is relatively flat and blunt. In profile view, crossing chisel crests 215, 232 are preferably elongate and relatively flat chisel-shaped crests characterized by a crest tangent angle between 65° and 90° as measured at any point along the crest profile between insert axis 208 and 15% of the diameter of insert 200.

As with the embodiments of FIGS. 3-6, in profile view, crests 215, 232 of insert 200 extend substantially linearly away from insert axis 208 for some distance before curving or tapering sharply downward toward base portion 201. This is in contrast to many conventional conical inserts that have a more pointed cutting tip in profile view resulting in a cutting surface that extends linearly down and away from the apex of the cutting tip towards the base of the insert.

As with cutting surface 103 previously described, cutting surface 203 of insert 200 is preferably continuously contoured, thereby offering the potential to reduce stress concentrations in the cutting surface.

Figure 15:
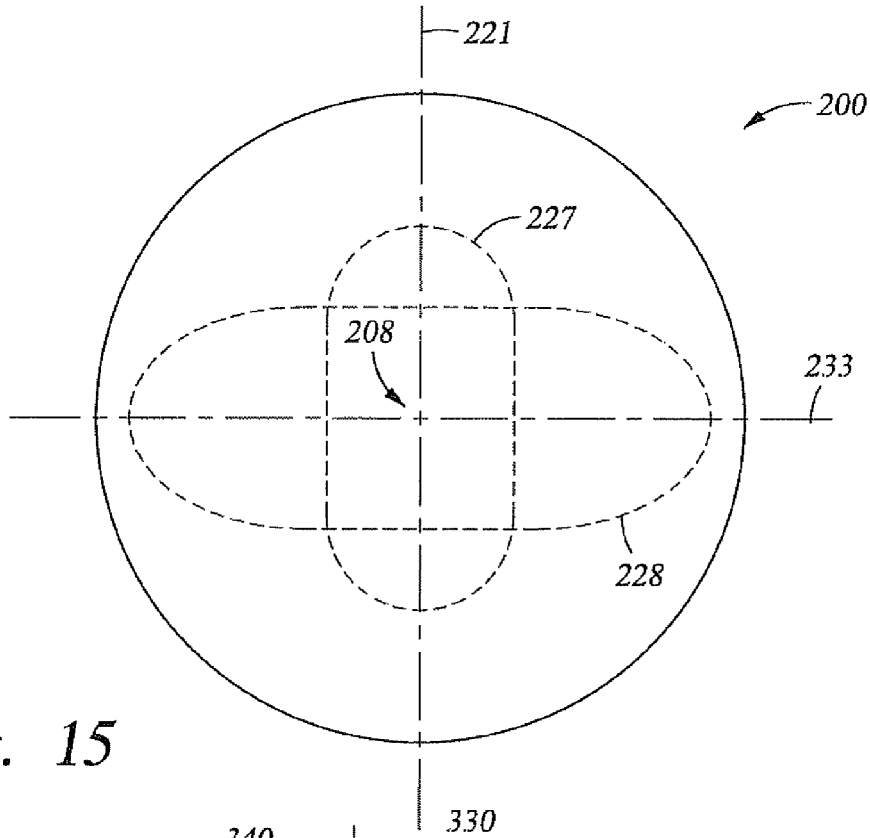
FIG. 15 is a schematic top view of the cutter element shown in FIGS. 11-14.

Referring now to FIG. 15, a top schematic view of insert 200 similar to that of insert 100 shown in FIG. 9 in illustrated. Dashed line 227 schematically represents the top profile of elongate chisel crest 215, and dashed line 228 schematically represents the top profile of elongate chisel crest 232. As shown in this embodiment, chisel crests 215, 232 are generally perpendicular to each other and bisect each other into substantially equal halves. In addition, each crest 215, 232 is position such that its median line 221, 233, respectively, passes through the insert axis 208. Thus, in this embodiment, each crest 215, 232 may be described as having zero offset from the insert axis. Moreover, in this embodiment, the length of crest 232 is substantially greater than the length of crest 215. Since chisel crest 232 represents the upper peaked ridged of chisel structure 230, although chisel structure 230 extends beyond the diameter or footprint of base portion 201 (FIG. 14), in the top schematic view of insert 200 shown in FIG. 15 chisel crest 232 does not quite extend beyond the diameter of base portion 201.

As described in more detail below, in other embodiments, the crossing crests (e.g., crossing crests 215, 232) may not be perpendicular, but rather, may intersect to form acute angles therebetween. Further, in other embodiments, one or both chisel crests may be offset from the insert axis and/or not bisect the other crest. For instance, a first crossing crest may be positioned closer to one end of a second crossing crest that the second crossing crest would be divided into two crest segments of unequal length.

Figure 16:
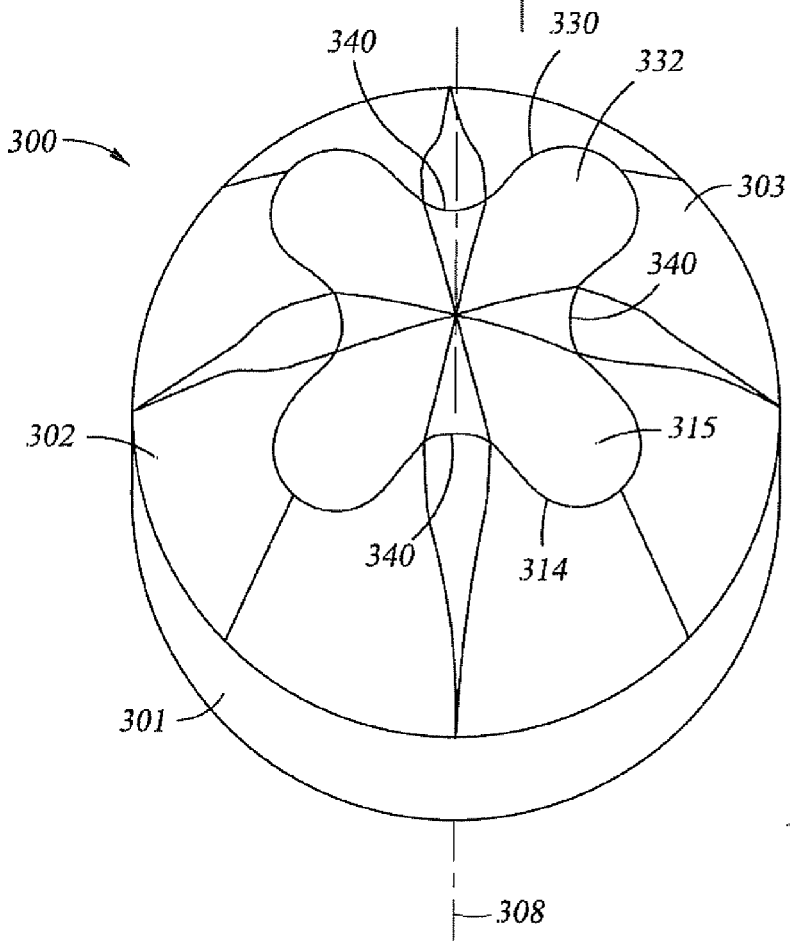
FIG. 16 is a perspective view of an embodiment of a cutter element having particular application in a rolling cone bit, such as that shown in FIGS. 1 and 2.
Figure 18:
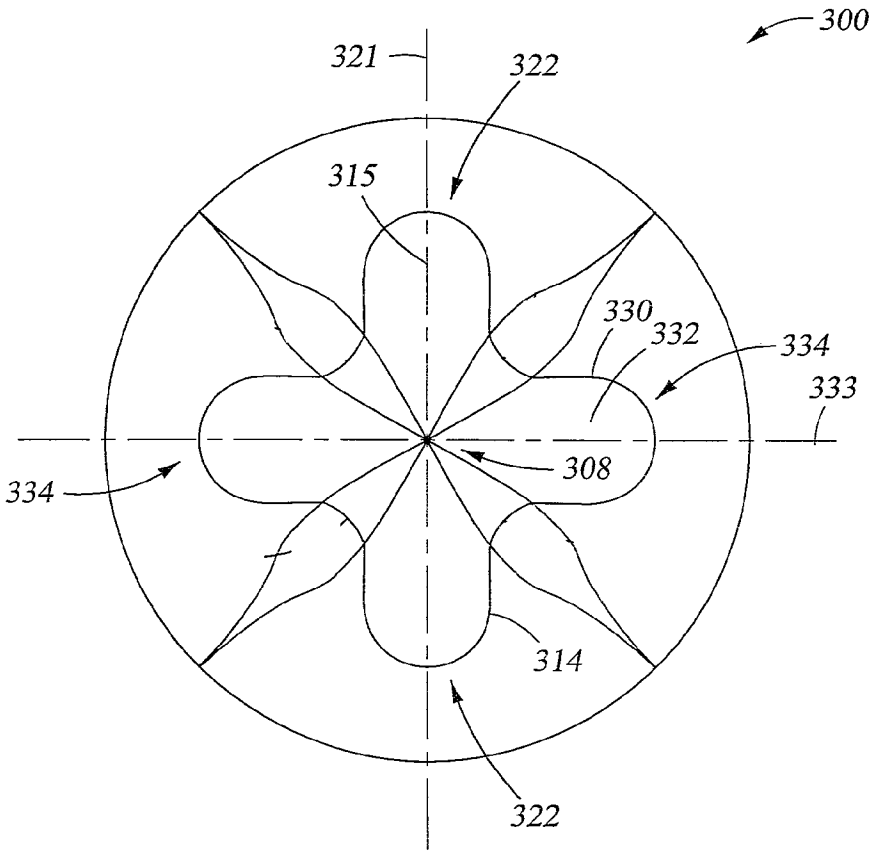
FIG. 18 is a top view of the cutter element shown in FIG. 16.
Figure 17:
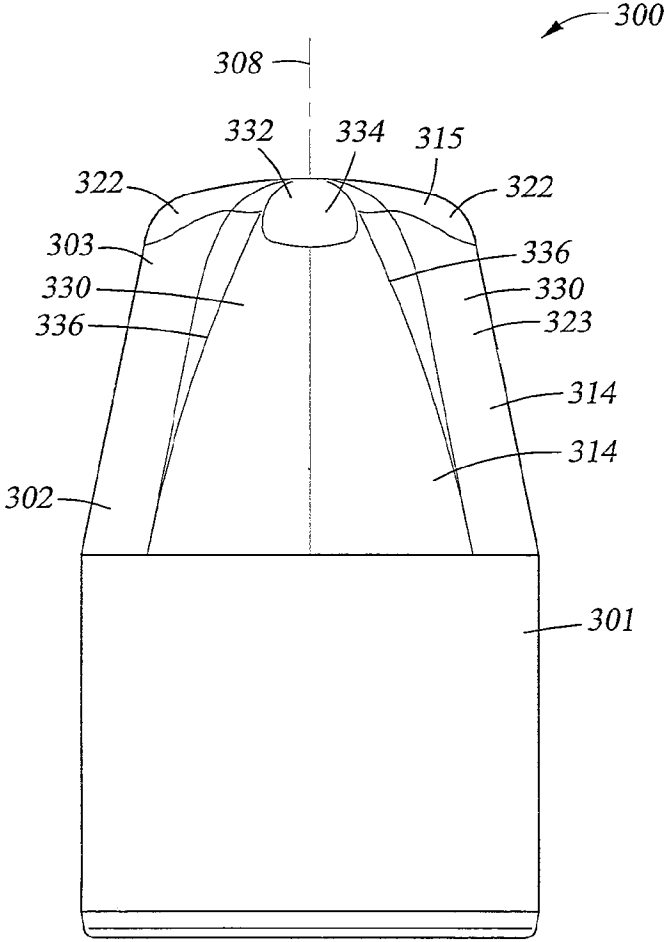
FIG. 17 is a front elevation view of the cutter element shown in FIG. 16.
Figure 19:
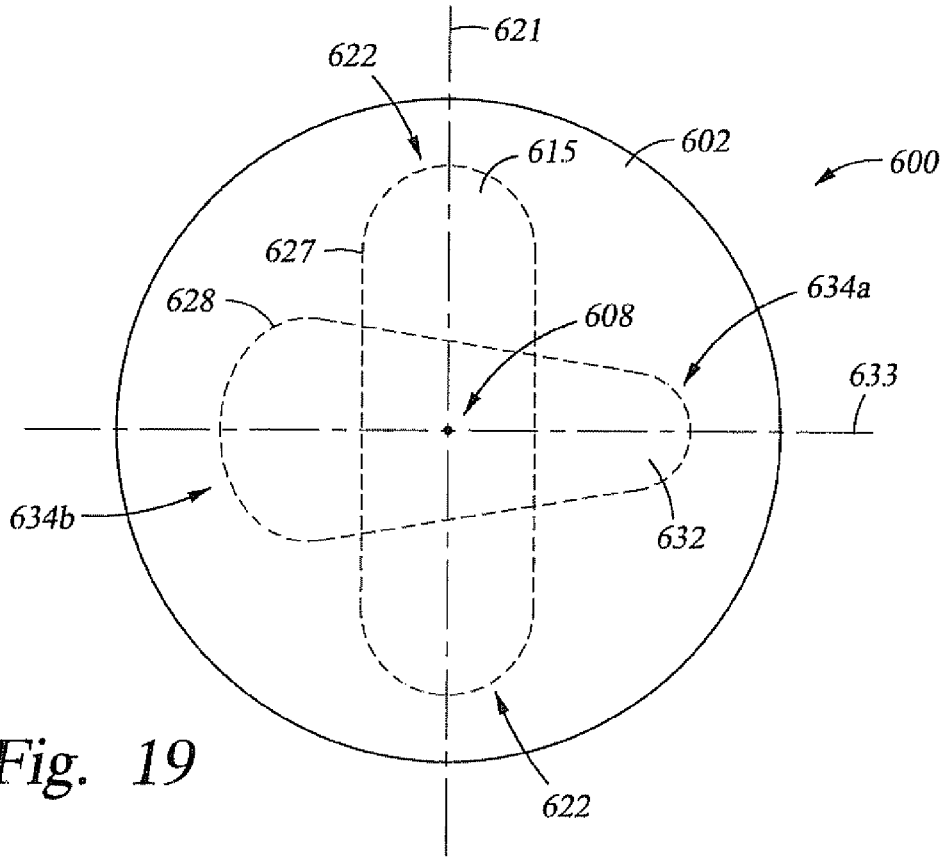
FIGS. 19-22 are schematic top views of alternative cutter elements having application in a rolling cone bit, such as that shown in FIGS. 1 and 2.

Referring now to FIGS. 16-18, a cutter element 300 is shown. Cutter element 300 is believed to have particular utility when employed as an inner row cutter element, such as in inner rows 81*a* or 82*a* shown in FIGS. 1 and 2 above. However, cutter element 300 may also be employed in other rows and other regions on the cone cutter, such as in heel row 60*a* and gage rows 70*a*, 70*b* shown in FIGS. 1 and 2.

Cutter element or insert 300 includes a base portion 301, substantially identical to base 101 previously described, and a cutting portion 302 extending therefrom and having a cutting surface 303. Base portion 301 has a central axis 308.

Cutting portion 302 includes a first chisel structure 314 comprising flanking surface 323 that taper towards each other to form an elongate chisel crest 315, and a second chisel structure 330 comprising flanking surfaces 336 that taper towards each other to form an elongate chisel crest 332. First chisel structure 314 and second chisel structure 330 have substantially the same extension height. Chisel crest 315 extends generally linearly along crest median line 321 between crest ends 322, and likewise, chisel crest 332 extends generally linearly along crest median line 333 between crest ends 334. In the embodiment shown in FIGS. 16-18, second crest 232 is substantially perpendicular to first crest 315 (FIG. 18). In addition, in this embodiment, each elongate chisel crest 315, 332 is centered relative to insert axis 308, and generally bisects the other chisel crest. Moreover, in this embodiment, insert 300 is symmetric about insert axis 308, crest median line 321, and crest median line 333. Unlike elongate chisel crests 215, 232 of insert 200 previously described, crossing elongate chisel crests 315, 332 have substantially the same length, and further, neither chisel structure 314, 330 extends radially beyond the diameter of base portion 301.

As viewed in the front profile of FIG. 17, each elongate chisel crest 315, 332 is slightly convex between crest ends 322, 334. As with the embodiment shown in FIGS. 3-6, cutting surface 303 of insert 300 is free of a sharp point or apex and instead is relatively flat and blunt. In profile view, crossing chisel crests 315, 332 are preferably elongate and relatively flat chisel-shaped crests characterized by a crest tangent angle between 65° and 90° as measured at any point along the crest profile between insert axis 308 and 15% of the diameter of insert 300.

Thus, in contrast to some inserts that have a generally pointed cutting tip and cutting surface that extends linearly down and away from the apex of the cutting tip towards the base of the insert (e.g., conical inserts), in profile view, crests 315, 332 of insert 300 extend substantially linearly away from insert axis 308 for some distance before curving or tapering sharply downward toward base portion 301.

FIGS. 19-22 are similar to the view of FIG. 9, and show, in schematic fashion, alternative cutter elements made in accordance with the principles described herein. In particular, FIG.

19 shows a cutter element or insert 600 having an insert axis 608 and a cutting portion 602 including a first elongate chisel crest 615 with a top profile 627, and a second elongate chisel crest 632 with a top profile 628. Crest 615 extends substantially linearly along a crest median line 621 between crest ends 622. Crest 632 extends substantially linearly along a crest median line 633 between crest ends 634*a, b*. In this embodiment crest median lines 621, 633 are substantially perpendicular to each other, and further, each intersects insert axis 608 (i.e., crests 615, 632 have zero offset from insert axis 608).

Crossing chisel crests 615, 632 are preferably elongate and relatively flat chisel-shaped crests characterized by a crest tangent angle $\alpha$ between 65° and 90° as measured at any point along the crest profile between insert axis 608 and 15% of the insert diameter.

Although crest ends 622 are substantially uniform, crest ends 634*a, b* are not uniform. In particular, crest 630 is formed by diverging flanks which extend from a relatively narrow crest end 634*a* to a relatively wider crest end 634*b*. In certain formations, and in certain positions in a rolling cone cutter, it is desirable to have a crest end (e.g., relatively larger crest end 634*b*) with a greater mass of insert material. The increased mass of insert material may be preferred for a variety of reasons including, without limitation, to improve wear resistance, to provide additional strength, to buttress a region of the insert especially susceptible to chipping, or combinations thereof.

Figure 20:
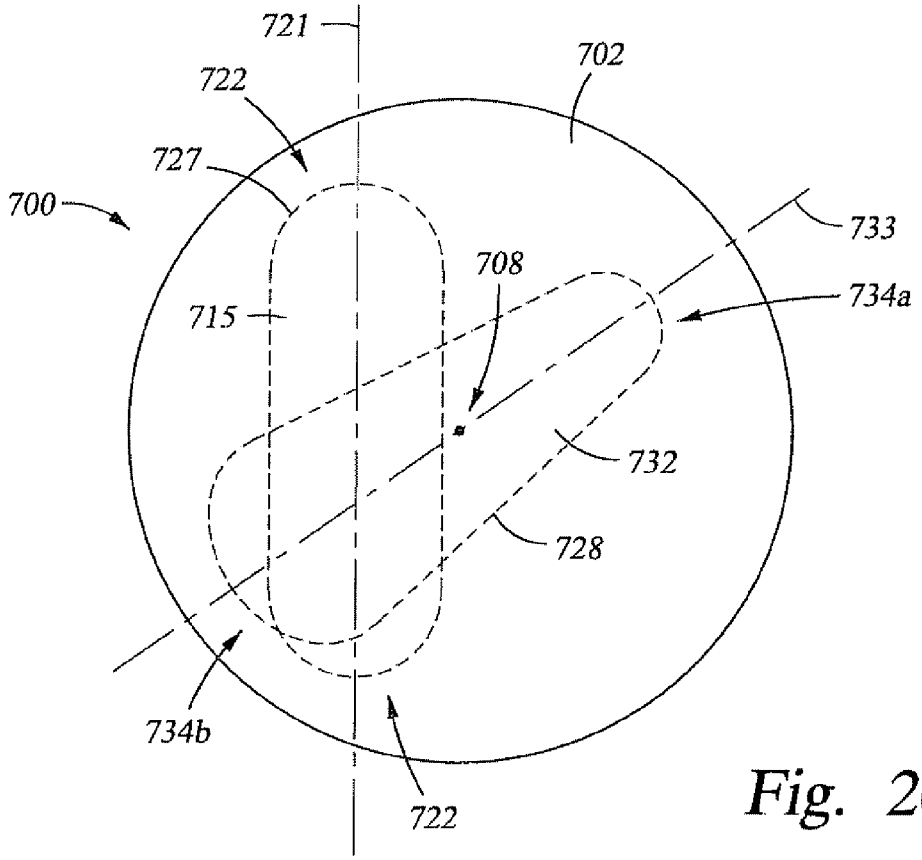

Referring now to FIG. 20, an insert 700 having an insert axis 708, a cutting portion 702, a first elongate crest 715, and a second elongate crest 732 is illustrated in schematic fashion. Chisel crest 715 is schematically represented by top profile 727, and chisel crest 732 is schematically represented by top profile 728. Crest 715 extends substantially linearly along a crest median line 721 between crest ends 722. Crest 732 extends substantially linearly along a crest median line 733 between crest ends 734*a, b*. In this embodiment crest median lines 721, 733 are not perpendicular, but rather, are oriented at an acute angle relative to each other. Further, in this embodiment, crest median line 733 intersects insert axis 708 (i.e., crest 732 has zero offset from insert axis 708), however, crest median line 721 is offset from insert axis 708. In other words, crest median line 721 does not intersect insert axis 708. As a result, crest 715 is not positioned equidistance from crest ends 734*a, b* of crest 732. In particular, crest 715 is positioned closer to larger crest end 734*b* of crest 732. Crossing chisel crests 715, 732 are preferably elongate and relatively flat chisel-shaped crests in side and front profile view. Further, chisel crests 715, 732 preferably have substantially the same extension height.

As previously described, in certain formations, and in certain positions in a rolling cone cutter, it is desirable to have a crest end (e.g., relatively larger crest end 734*b*) with a greater mass of insert material. In addition, depending on the position in a rolling cone cutter, the projected path of an insert may not result in a purely linear sweeping motion through the formation (e.g., the insert may experience twisting and/or helical movement in the bottomhole). In such cases, it may be desirable for the crossing crests 715, 732 to be oriented at an acute angle relative to each other to optimize the orientation of impact and hence formation removal by insert 700.

Figure 21:
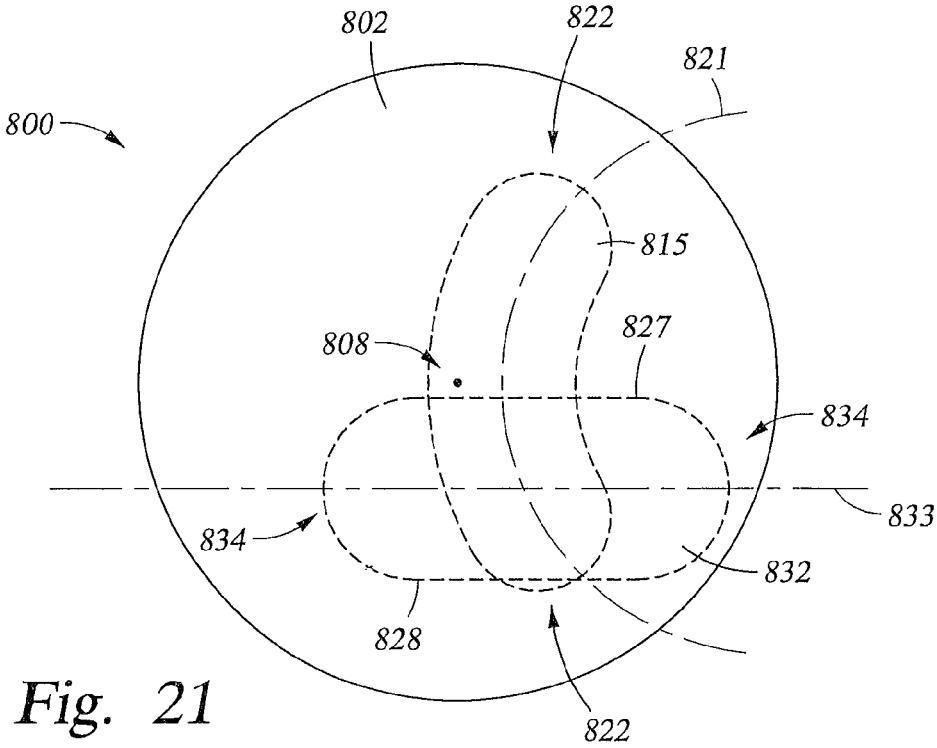

Referring now to FIG. 21, an insert 800 having an insert axis 808, a cutting portion 802, a first elongate crest 815, and a second elongate crest 832 is illustrated in schematic fashion. Chisel crest 815 is schematically represented by top profile 827, and chisel crest 832 is schematically represented by top profile 828. Crest 832 extends substantially linearly along a crest median line 833 between uniform crest ends 834. Crest 815 is generally elongate and extends between crest ends 822, however, crest median line 821 of crest 815 is not straight in top view, but rather is arcuate or curved.

In this embodiment, crest median lines 821, 833 are substantially perpendicular at their point of intersection. Further, in this embodiment, both crest median lines 821, 833 are offset from insert axis 808 (i.e., neither crest median line 821, 833 intersects insert axis 808). Crossing chisel crests 815, 832 are preferably elongate and relatively flat chisel-shaped crests in side and front profile view. Moreover, chisel crests 815, 832 preferably have substantially the same extension height.

Figure 22:
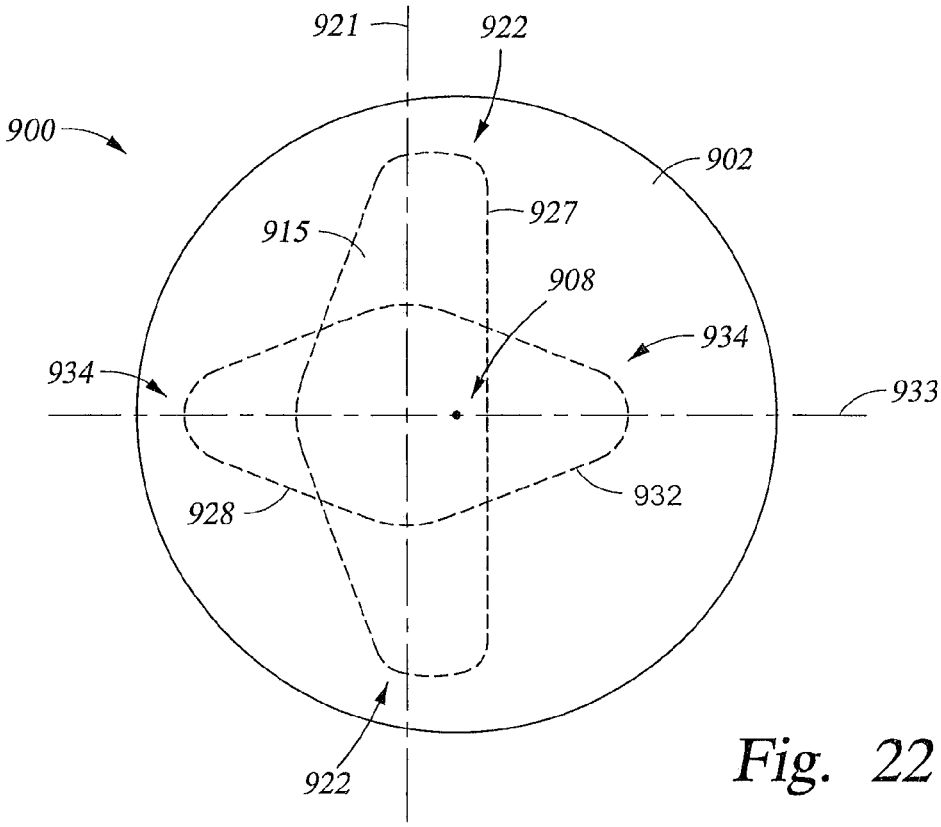

Referring now to FIG. 22, an insert 900 comprising an insert axis 908 and a cutting portion 902 including a first elongate chisel crest 915 and a second elongate chisel crest 932 is schematically illustrated. Chisel crest 915 is schematically represented by top profile 927, and chisel crest 932 is schematically represented by top profile 928. Crest 915 extends substantially linearly along a crest median line 921 between uniform crest ends 922. Likewise, crest 932 extends substantially linearly along a crest median line 933 between uniform crest ends 934. However, in this embodiment, crests 915, 932 each include a broadened central region comprising an increased volume of insert material.

Crest median lines 921, 933 are substantially perpendicular, although crest median line 921 is offset from insert axis 908. Crossing chisel crests 915, 932 are preferably elongate and relatively flat chisel-shaped crests in side and front profile view. Moreover, chisel crests 915, 932 preferably have substantially the same extension height.

The materials used in forming the various portions of cutter elements 100, 200 may be particularly tailored to best perform and best withstand the type of cutting duty experienced by that portion of the cutter element. For example, it is known that as a rolling cone cutter rotates within the borehole, different portions of a given insert will lead as the insert engages the formation and thereby be subjected to greater impact loading than a lagging or following portion of the same insert. With many conventional inserts, the entire cutter element was made of a single material, a material that of necessity was chosen as a compromise between the desired wear resistance or hardness and the necessary toughness. Likewise, certain conventional gage cutter elements include a portion that performs mainly side wall cutting, where a hard, wear resistant material is desirable, and another portion that performs more bottom hole cutting, where the requirement for toughness predominates over wear resistance. With the inserts 100, 200 described herein, the materials used in the different regions of the cutting portion can be varied and optimized to best meet the cutting demands of that particular portion.

More particularly, depending on the position and orientation of inserts 100, 200 in a rolling cone cutter, it may be desirable to form different portions cutting portion 102, 202 of inserts 100, 200, respectively, with different materials having different mechanical properties. For example, those portions of inserts 100, 200 that will tend to experience more force per unit area upon the insert's initial contact with the formation may be made from a tougher, more fracture-resistant material than those portions of insets 100, 200 that will tend to experience more abrasive, scraping action against the formation. Such portions of inserts 100, 200 likely to experience more abrasive, scraping action as they engage the formation may be made from a harder, more wear-resistant material.

Cemented tungsten carbide is a material formed of particular formulations of tungsten carbide and a cobalt binder (WC—Co) and has long been used as cutter elements due to the material's toughness and high wear resistance. Wear resistance can be determined by several ASTM standard test methods. It has been found that the ASTM B611 test correlates well with field performance in terms of relative insert wear life. It has further been found that the ASTM B771 test, which measures the fracture toughness (Klc) of cemented tungsten carbide material, correlates well with the insert breakage resistance in the field.

It is commonly known that the precise WC—Co composition can be varied to achieve a desired hardness and toughness. Usually, a carbide material with higher hardness indicates higher resistance to wear and also lower toughness or lower resistance to fracture. A carbide with higher fracture toughness normally has lower relative hardness and therefore lower resistance to wear. Therefore there is a trade-off in the material properties and grade selection.

It is understood that the wear resistance of a particular cemented tungsten carbide cobalt binder formulation is dependent upon the grain size of the tungsten carbide, as well as the percent, by weight, of cobalt that is mixed with the tungsten carbide. Although cobalt is the preferred binder metal, other binder metals, such as nickel and iron can be used advantageously. In general, for a particular weight percent of cobalt, the smaller the grain size of the tungsten carbide, the more wear resistant the material will be. Likewise, for a given grain size, the lower the weight percent of cobalt, the more wear resistant the material will be. However, another trait critical to the usefulness of a cutter element is its fracture toughness, or ability to withstand impact loading. In contrast to wear resistance, the fracture toughness of the material is increased with larger grain size tungsten carbide and greater percent weight of cobalt. Thus, fracture toughness and wear resistance tend to be inversely related. Grain size changes that increase the wear resistance of a given sample will decrease its fracture toughness, and vice versa.

As used herein to compare or claim physical characteristics (such as wear resistance, hardness or fracture-resistance) of different cutter element materials, the term "differs" or "different" means that the value or magnitude of the characteristic being compared varies by an amount that is greater than that resulting from accepted variances or tolerances normally associated with the manufacturing processes that are used to formulate the raw materials and to process and form those materials into a cutter element. Thus, materials selected so as to have the same nominal hardness or the same nominal wear resistance will not "differ," as that term has thus been defined, even though various samples of the material, if measured, would vary about the nominal value by a small amount.

There are today a number of commercially available cemented tungsten carbide grades that have differing, but in some cases overlapping, degrees of hardness, wear resistance, compressive strength and fracture toughness. Some of such grades are identified in U.S. Pat. No. 5,967,245, the entire disclosure of which is hereby incorporated by reference.

Embodiments of the inserts disclosed herein (e.g., inserts 100, 200) may be made in any conventional manner such as the process generally known as hot isostatic pressing (HIP). HIP techniques are well known manufacturing methods that employ high pressure and high temperature to consolidate metal, ceramic, or composite powder to fabricate components in desired shapes. Information regarding HIP techniques useful in forming inserts described herein may be found in the book *Hot Isostatic Processing* by H. V. Atkinson and B. A. Rickinson, published by IOP Publishing Ptd., ©1991 (ISBN 0-7503-0073-6), the entire disclosure of which is hereby incorporated by this reference. In addition to HIP processes, the inserts and clusters described herein can be made using other conventional manufacturing processes, such as hot pressing, rapid omnidirectional compaction, vacuum sintering, or sinter-HIP.

The embodiments disclosed herein may also include coatings comprising differing grades of super abrasives. Super abrasives are significantly harder than cemented tungsten carbide. As used herein, the term "super abrasive" means a material having a hardness of at least 2,700 Knoop (kg/mm$^2$). PCD grades have a hardness range of about 5,000-8,000 Knoop (kg/mm$^2$) while PCBN grades have hardnesses which fall within the range of about 2,700-3,500 Knoop (kg/mm$^2$). By way of comparison, conventional cemented tungsten carbide grades typically have a hardness of less than 1,500 Knoop (kg/mm$^2$). Such super abrasives may be applied to the cutting surfaces of all or some portions of the inserts. In many instances, improvements in wear resistance, bit life and durability may be achieved where only certain cutting portions of inserts include the super abrasive coating.

Certain methods of manufacturing cutter elements with PDC or PCBN coatings are well known. Examples of these methods are described, for example, in U.S. Pat. Nos. 5,766,394, 4,604,106, 4,629,373, 4,694,918 and 4,811,801, the disclosures of which are all incorporated herein by this reference.

Thus, according to these examples, employing multiple materials and/or selective use of superabrasives, the bit designer, and ultimately the driller, is provided with the opportunity to increase ROP, and bit durability.

While preferred embodiments have been shown and described, modifications thereof can be made by one skilled in the art without departing from the teaching herein. The embodiments described herein are exemplary only and are not limiting. Many variations and modifications of the system and apparatus are possible and are within the scope of the invention. Accordingly, the scope of protection is not limited to the embodiments described herein, but is only limited by the claims which follow, the scope of which shall include all equivalents of the subject matter of the claims.

What is claimed is:

1. A cutter element for a drill bit comprising:

a base portion having a diameter and a central axis;

a cutting portion extending from the base portion and defining an extension height;

wherein the cutting portion includes a first pair of flanking surfaces that taper towards one another to form a first elongate chisel crest, and a second pair of flanking surfaces that taper towards one another to form a second elongate chisel crest that crosses the first elongate chisel crest in top view;

wherein the first elongate chisel crest extends along a first crest median line from a first crest end to a second crest end;

wherein the first pair of flanking surfaces includes a first flanking surface and a second flanking surface that is directly opposed to the first flanking surface across the first crest median line proximal the first crest end;

wherein the first elongate chisel crest defines a first crest tangent angle in front profile view; and wherein the first crest tangent angle at 10% of the diameter measured radially from the central axis on the first elongate chisel crest in profile view is greater than 75° and less than or equal to 90°.

2. The cutting element of claim 1 wherein the first crest tangent angle at 15% of the diameter measured radially from the central axis on the first elongate chisel crest in profile view is greater than 65° and less than or equal to 90°.

3. The cutting element of claim 2 wherein the first crest tangent angle at 15% of the diameter measured radially from the central axis on the first elongate chisel crest in profile view is greater than 75° and less than or equal to 90°.

4. The cutting element of claim 2 wherein the first crest tangent angle at 20% of the diameter measured radially from the central axis on the first elongate chisel crest in profile view is greater than 55° and less than or equal to 90°.

5. The cutting element of claim 2 wherein the second elongate chisel crest defines a second crest tangent angle in profile view, and wherein the second crest tangent angle at 10% of the diameter measured radially from the central axis on the second elongate chisel crest in profile view is greater than 75° and less than or equal to 90°, and wherein the second crest tangent angle at 15% of the diameter measured radially from the central axis on the second elongate chisel crest in profile view is greater than 65° and less than or equal to 90°.

6. The cutting element of claim 1 wherein at least a portion of the first elongate chisel crest and at least a portion of the second elongate chisel crest each extend to the extension height.

7. The cutting element of claim 1 wherein the first elongate crest extends between a first crest end and a second crest end, and wherein the first elongate chisel crest is convex therebetween in profile view.

8. The cutting element of claim 7 wherein the first elongate crest has a longitudinal radius of curvature between the first crest end and the second crest end, wherein the ratio of the longitudinal radius of curvature to the diameter is at least 0.7.

9. The cutting element of claim 7 wherein the second elongate chisel crest extends between a first crest end and a second crest end, wherein the second elongate chisel crest is convex therebetween in profile view.

10. The cutter element of claim 1 wherein the first elongate chisel crest and the second elongate chisel crest are substantially perpendicular in top view.

11. The cutter element of claim 10 wherein the first elongate chisel crest has a crest median line that is substantially linear in top view, and the second elongate chisel crest has a crest median line that is substantially linear in top view.

12. The cutter element of claim 1 wherein the first elongate chisel crest extends between a first crest end and a second crest end, wherein the first crest end is wider than the second crest end in top view.

13. A cutter element for a drill bit comprising:

a base portion;

a cutting portion extending from the base portion and defining an extension height;

wherein the cutting portion has a cutting surface, the entire cutting surface of the entire cutting portion is a continuously contoured surface;

wherein the cutting surface comprises a first elongate chisel crest and a second elongate chisel crest that crosses the first elongate chisel crest;

wherein at least a portion of each of the first elongate chisel crest and the second elongate chisel crest extend to the extension height;

wherein the first elongate chisel crest includes a first crest end and a second crest end, and is continuously curved therebetween in front profile view.

14. The cutter element of claim 13 wherein the first elongate chisel crest is convex between the first crest end and the second crest end.

15. The cutter element of claim 13 wherein the base portion has a diameter and a central axis;

wherein the first elongate chisel crest defines a first crest tangent angle in profile view; and wherein the first crest tangent angle at any point between the central axis and 10% of the diameter measured radially from the central axis on the first elongate chisel crest in profile view is greater than 75° and less than or equal to 90°.

16. The cutter element of claim 15 wherein the first crest tangent angle at any point between the central axis and 15% of the diameter measured radially from the central axis on the first elongate chisel crest in profile view is greater than 65° and less than or equal to 90°.

17. The cutter element of claim 16 wherein the second elongate chisel crest defines a second crest tangent angle in profile view;

wherein the second crest tangent angle at any point between the central axis and 15% of the diameter measured radially from the central axis on the second elongate chisel crest in profile view is greater than 65° and less than or equal to 90°.

18. A drill bit for cutting a borehole having a borehole sidewall, corner and bottom, the drill bit comprising:

a bit body including a bit axis;

a rolling cone cutter mounted on the bit body and adapted for rotation about a cone axis;

at least one cutter element having a base portion with a diameter secured in the rolling cone cutter and a cutting portion extending therefrom;

the cutting portion comprising a first pair of flanking surfaces that taper towards one another to form a first elongate chisel crest, and a second pair of flanking surfaces that taper towards one another to form a second elongate chisel crest that crosses the first elongate chisel crest in top view;

wherein the first elongate chisel crest extends along a first crest median line from a first crest end to a second crest end;

wherein the first pair of flanking surfaces includes a first flanking surface and a second flanking surface that is directly opposed to the first flanking surface across the first crest median line proximal the first crest end;

wherein the first elongate chisel crest defines a first crest tangent angle in front profile view; and wherein the first crest tangent angle at 10% of the diameter measured radially from the central axis on the first elongate chisel crest in profile view is greater than 75° and less than or equal to 90°.

19. The drill bit of claim 18 wherein the first elongate chisel crest includes a first crest end and a second crest end, and is continuously curved therebetween in front profile view.

20. The drill bit of claim 19 wherein the at least one cutter element is positioned in the cone cutter such that the second crest end is closer to the bit axis than the first crest end.

21. The drill bit of claim 20 wherein the at least one cutter element is oriented in the cone cutter such that the first crest end is positioned to at least partially engage the borehole sidewall.

22. The drill bit of claim 18 wherein the cutting portion defines an extension height of the at least one cutter element, and wherein the first elongate chisel crest and the second elongate chisel crest each extend at least partially to the extension height.

23. The drill bit of claim 22 wherein the first elongate chisel crest is convex between the first crest end and the second crest end in profile view, and wherein the second elongate chisel crest includes a first crest end and a second crest end, and is convex therebetween in profile view.

24. The drill bit of claim 22 wherein the base portion has a diameter and a central axis;

wherein the first elongate chisel crest defines a first crest tangent angle in profile view; and wherein the first crest tangent angle at any point between the central axis and 15% of the diameter measured radially from the central axis on the first elongate chisel crest in profile view is greater than 65° and less than or equal to 90°.

25. The drill bit of claim 24 wherein the second elongate chisel crest defines a second crest tangent angle in profile view;

wherein the second crest tangent angle at any point between the central axis and 15% of the diameter measured radially from the central axis on the second elongate chisel crest in profile view is greater than 65° and less than or equal to 90°.

* * * * *